US010638843B2

(12) United States Patent
Andoloro et al.

(10) Patent No.: US 10,638,843 B2
(45) **Date of Patent: *May 5, 2020**

(54) APPARATUS FOR SUPPORT DURING TATTOOING

(71) Applicant: InkBed, Inc., Everett, WA (US)

(72) Inventors: Cosmo J. Andoloro, Puyallup, WA (US); Kevin Richardson, Everett, WA (US)

(73) Assignee: InkBed, Inc., Everett, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/727,896

(22) Filed: Oct. 9, 2017

(65) Prior Publication Data

US 2018/0027966 A1 Feb. 1, 2018

Related U.S. Application Data

(63) Continuation of application No. 15/004,837, filed on Jan. 22, 2016, which is a continuation-in-part of (Continued)

(51) Int. Cl.

| | |
|---|---|
| ***A47C 1/03*** | (2006.01) |
| ***A47C 1/034*** | (2006.01) |
| ***A47C 1/06*** | (2006.01) |
| ***A47C 31/00*** | (2006.01) |
| ***A47C 1/026*** | (2006.01) |
| ***A47C 3/18*** | (2006.01) |

(Continued)

(52) U.S. Cl.

CPC ..... *A47C 1/0342* (2013.01); *A47C 1/024* (2013.01); *A47C 1/026* (2013.01); *A47C 1/03* (2013.01); *A47C 1/06* (2013.01); *A47C 3/18* (2013.01); *A47C 7/503* (2013.01); *A47C 7/506* (2013.01); *A47C 31/008* (2013.01)

(58) Field of Classification Search

CPC ..... A47C 1/0342; A47C 1/024; A47C 1/026; A47C 1/03; A47C 1/06; A47C 3/18; A47C 7/503; A47C 7/506; A47C 31/008

See application file for complete search history.

(56) References Cited

U.S. PATENT DOCUMENTS

| | | | |
|---|---|---|---|
| 3,145,053 | A | 8/1964 | Thompson et al. |
| 3,188,136 | A | 6/1965 | Redfield et al. |

(Continued)

FOREIGN PATENT DOCUMENTS

| | | | |
|---|---|---|---|
| CN | 2151738 | Y | 1/1994 |
| CN | 201119969 | Y | 9/2008 |

(Continued)

OTHER PUBLICATIONS

"Hydraulic All Purpose Tattoo Chair KI New York", http://www.puretat.com, accessed Jan. 18, 2010, 2 pages.

(Continued)

*Primary Examiner* — Philip F Gabler
(74) *Attorney, Agent, or Firm* — Perkins Coie LLP

(57) ABSTRACT

An apparatus that supports a person in a variety of positions so that a tattoo artist can comfortably apply a tattoo to the skin of the supported person is herein disclosed. The apparatus can be articulated to cause a person's legs and arms to be optimally positioned and supported to receive a tattoo.

28 Claims, 25 Drawing Sheets

Related U.S. Application Data application No. 14/164,035, filed on Jan. 24, 2014, now Pat. No. 9,375,088, which is a continuation of application No. 12/876,593, filed on Sep. 7, 2010, now Pat. No. 8,651,569.

(51) Int. Cl.
*A47C 7/50* (2006.01)
*A47C 1/024* (2006.01)

(56) References Cited

U.S. PATENT DOCUMENTS

| | | | | |
|---|---|---|---|---|
| 3,227,440 | A | 1/1966 | Scott | |
| 4,159,145 | A | 6/1979 | Quakenbush | |
| 4,170,800 | A | 10/1979 | Wiberg | |
| 4,285,541 | A | 8/1981 | Onishi | |
| 4,387,888 | A | 6/1983 | Marinakis | |
| 4,516,805 | A | 5/1985 | Leeper et al. | |
| 4,650,249 | A | 3/1987 | Serber | |
| 4,660,549 | A | 4/1987 | Kowalski et al. | |
| 4,795,214 | A | 1/1989 | Holdt | |
| 4,832,407 | A | 5/1989 | Serber | |
| 5,060,327 | A | 10/1991 | Celestina et al. | |
| 5,086,769 | A | 2/1992 | Vianello et al. | |
| 5,098,158 | A | 3/1992 | Palarski | |
| 5,315,722 | A | 5/1994 | Djie | |
| 5,401,078 | A | 3/1995 | Riach | |
| 5,487,590 | A | 1/1996 | Haynes | |
| 5,642,542 | A | 7/1997 | Kometani | |
| 5,645,313 | A | 7/1997 | Best et al. | |
| 5,653,499 | A | 8/1997 | Goodall | |
| 5,678,894 | A | 10/1997 | Eley | |
| 5,762,402 | A | 6/1998 | Gillotti | |
| 5,967,610 | A | 10/1999 | Lin | |
| 5,971,475 | A | 10/1999 | Lawson et al. | |
| 5,971,485 | A | 10/1999 | Clark | |
| 6,089,593 | A | 7/2000 | Hanson et al. | |
| 6,135,548 | A | 10/2000 | McGuire | |
| 6,212,713 | B1 | 4/2001 | Kuck et al. | |
| 6,315,319 | B1 | 11/2001 | Hanson et al. | |
| 6,446,287 | B2 | 9/2002 | Borders | |
| 6,619,747 | B2 | 9/2003 | Ko et al. | |
| 6,767,066 | B1 | 7/2004 | Tornero | |
| 6,824,219 | B2 | 11/2004 | Ruckstadter | |
| 6,846,042 | B2 | 1/2005 | Hanson et al. | |
| 6,918,143 | B2 | 7/2005 | Wiberg | |
| 7,021,037 | B1 | 4/2006 | Szymas | |
| 7,080,885 | B2 | 7/2006 | Bain et al. | |
| 7,234,768 | B2 | 6/2007 | Manning | |
| 7,293,834 | B2 | 11/2007 | Riach et al. | |
| 7,600,817 | B2 | 10/2009 | Kramer et al. | |
| 7,784,871 | B2 | 8/2010 | Cochran | |
| 8,651,569 | B2 | 2/2014 | Andoloro et al. | |
| 9,084,486 | B1 | 7/2015 | Richardson et al. | |
| 9,375,088 | B2 | 6/2016 | Andoloro | |
| 9,451,831 | B2 | 9/2016 | Richardson et al. | |
| 10,264,885 | B2 * | 4/2019 | Andoloro | A47C 1/026 |
| 2002/0000008 | A1 | 1/2002 | Borders | |
| 2002/0067060 | A1 | 6/2002 | Lloyd | |
| 2004/0133979 | A1 * | 7/2004 | Newkirk | A61G 13/0036 5/600 |
| 2006/0225212 | A1 | 10/2006 | Parson et al. | |
| 2007/0035164 | A1 | 2/2007 | North | |
| 2007/0052275 | A1 | 3/2007 | Ghilzai | |
| 2009/0250565 | A1 | 10/2009 | Jaggers et al. | |
| 2009/0295213 | A1 * | 12/2009 | White | A47C 7/024 297/423.1 |
| 2010/0295357 | A1 | 11/2010 | Koehler et al. | |
| 2011/0272976 | A1 | 11/2011 | Wei et al. | |

FOREIGN PATENT DOCUMENTS

| | | | |
|---|---|---|---|
| WO | WO-2009056004 | A1 | 5/2009 |
| WO | WO-2011087232 | A2 | 7/2011 |
| WO | WO-2013078569 | A1 | 6/2013 |

OTHER PUBLICATIONS

"Traveler—The Ultimate Table", http://www.tattootable.com, Fab Tech, accessed Jan. 18, 2010, 3 pages.
"Tattoo-Chairs-table", http://www.tattoochair.com, © 2009, accessed Jan. 18, 2010, 7 pages.
"Tatsoul 370" http://www.tatsoul.com, accessed Feb. 2, 2010, 7 pages.
Extended European Search Report for European Application No. 15735366.5; dated Jul. 6, 2017; 7 pages.
International Searching Authority, International Search Report and Written Opinion, PCT Patent Application PCT/US2015/010910, dated May 11, 2015, 14 pages.

* cited by examiner

APPARATUS FOR SUPPORT DURING TATTOOING

CROSS-REFERENCE TO RELATED APPLICATIONS

This application is a continuation of U.S. patent application Ser. No. 15/004,837, filed on Jan. 22, 2016, and entitled "APPARATUS FOR SUPPORT DURING TATTOOING," which is a continuation-in-part of U.S. patent application Ser. No. 14/164,035, filed on Jan. 24, 2014, and entitled "APPARATUS FOR SUPPORT DURING TATTOOING," which is a continuation application of U.S. patent application Ser. No. 12/876,953, filed on Sep. 7, 2010, and entitled "APPARATUS FOR SUPPORT DURING TATTOOING," all of which are hereby incorporated by reference in their entireties.

BACKGROUND

The popularity of tattoos has increased and inspired refinement in tattoo equipment and the sophistication of tattoos themselves. A typical tattoo studio has a variety of tools to apply tattoos to clients. For example, a tattoo artist may have a tattoo chair, table, arm stand, foot rest, etc. All of these pieces of furniture take up space, yet may be required in order to properly apply tattoos.

The furniture used by tattoo artists is often not specifically designed to be used to apply tattoos, but rather, are used for other applications, such as in medical or beauty salon applications. Thus, prolonged use of the furniture for tattooing may be uncomfortable for both the tattoo artist and the client. For example, many tattoo artists use massage tables to apply tattoos to a client's back, shoulders, or legs. Because massage tables were not designed for the ergonomic needs of a tattoo artist, they may cause discomfort or health problems for the artist.

Moreover, commonly used furniture in tattooing may not be able to place the client in a position that naturally stretches the skin of the area that is going to receive the tattoo. In order to receive a high-quality tattoo, the skin needs to be stretched; otherwise, the tattoo may be applied incorrectly (e.g., the tattoo may be disfigured). In order to compensate, a tattoo artist typically manually stretches and holds the client's skin while the tattoo is applied. This is uncomfortable for the tattoo artist, the client, or both. Additionally, the artist may not stretch the skin in a way that it would naturally stretch, resulting in distortion of the tattoo. Accordingly, there is a need for an apparatus that can be used to comfortably position a client for tattooing.

SUMMARY

An exemplary embodiment describes an apparatus for supporting a person during tattooing. The apparatus can be configured such that a client can be placed in an ergonomic position, for example, a position that is comfortable for the client, the tattoo artist, or both. For example, the apparatus can be reconfigurable to adjust between different positions, such as a bed position (e.g., a horizontal arrangement), a chair position (e.g., an arrangement for supporting the client in a sitting position by articulating certain sections of the apparatus relative to the floor), or other positions. In some embodiments, the apparatus can be manually moved between different configurations. During a tattoo session, the tattoo artist can manually move different sections of the apparatus to desired locations to facilitate applying the tattoo. In motorized embodiments, the apparatus can be electrically driven between different configurations using, for example, a controller. The controller can be operated by the client and/or tattoo artist.

In at least one exemplary embodiment, an apparatus can include arm sections, leg sections, a seat section, and a back section, some of which can be coupled to a frame. Each section can comfortably support and articulate different parts of a client's body during a tattoo session. For example, the arm sections can be raised, lowered, or angled in order to place the arms of a client in positions to comfortably support the arms while one or more tattoos are applied.

The leg sections can be attached such that each leg is independently movable. For example, each leg section can be rotatable in a direction perpendicular from a plane formed by the seat section. In one embodiment, each leg section can be independently rotatable about an axis parallel to a frontal plane and a transverse plane. For example, the leg sections can be rotated up to 70 degrees, 80 degrees, 90 degrees, or 100 degrees downward from a plane formed by the seat section, from a bed configuration to a chair configuration. In the same, or another embodiment, each leg section can also be rotated up to, for example, 70 degrees, 80 degrees, 90 degrees, or 100 degrees outward from the midsagittal line of the seat section to allow a tattoo artist access, for example, to the inner leg and/or lower back of a client.

In the same, or another embodiment, the back section can be attached such that it is independently rotatable in a direction that is perpendicular from a plane formed by the seat section. A client can sit with his or her back resting against the back section of the apparatus.

In one embodiment, the back section can be formed to include cuts defining leg openings. In this exemplary embodiment, and when the back section is articulated such that it is generally perpendicular to a plane formed by the seat section, the cuts can be formed such that the proximal end of the back section (e.g., the end closest to the seat section) is narrower in the frontal plane than the distal end of the seat section. In an exemplary embodiment, the cuts can be formed such that the back section looks like a cobra's hood.

A client can sit with his or her back or chest resting against the back section of the apparatus. When a client sits with his or her chest resting against the back section of the apparatus, the client can straddle the proximal portion of the back section by placing his or her legs through the cuts defining leg openings. In some embodiments, when the client's chest rests against the back rest, the client's thighs can be received by the leg openings. This position allows the client's lower legs to dangle down on the back side of the apparatus while the tattoo artist has access to the client's back.

In an exemplary embodiment, an apparatus can have a seat section with two rearwardly extending leg supporting segments that encircle the proximal portion of the back section. In this embodiment, the rearwardly extending leg supporting segments can support the thighs of a client while he or she is straddling the back section. In this exemplary embodiment, when the apparatus is in the bed configuration, the rearwardly extending leg supporting segments can form, along with the cuts defining leg openings, a generally flat surface for a client to lie on.

In some embodiments, an apparatus can include one or more support sections configured to move independent relative to one another and to be locked at various positions. For example, a tattoo artist can manually unlock, move, and then lock the support sections to reposition the support sections any number of times during a tattoo session. In some motorized embodiments, the apparatus can include one or more drive mechanisms for controllably positioning the support sections. The drive mechanisms can include, without limitation, one or more motors, actuators (e.g., linear actuators, rotary actuators, etc.), solenoids, servos, rail mechanisms (e.g., linear-rail mechanisms, carriage and rail mechanisms, etc.), and/or other components for providing desired motion. The motors can be, without limitation, drive motors, stepper motors, servomotors, or the like. Additionally or alternatively, apparatuses disclosed herein can include one or more electromechanical mechanisms, pneumatic mechanisms, hydraulic mechanisms, power supplies, and/or the like.

A controller can be used to position the support sections, such as a back section, a seat section, and/or leg sections. The controller can include input/output elements, memory, circuitry, processor(s), and other components. Input/output elements can be used to individually reposition each movable section. In some modes, the apparatus can be moved between preset configurations, which can be set and modified by a user. In other modes, the apparatus can be moved between non-preset configurations.

In some further embodiments, an apparatus for positioning a subject includes a seat section, a first leg assembly, a second leg assembly, a back section, a drive mechanism, and a controller. The first leg assembly is configured to support a first leg of the subject sitting on the seat section. The first leg assembly is rotatable about a first axis of rotation to raise and lower the first leg assembly and is rotatable about a second axis of rotation to move the first leg assembly toward or away from a midsagittal plane of the apparatus and/or seat section. The second leg assembly is configured to support a second leg of the subject sitting on the seat section. The second leg assembly is rotatable about a third axis of rotation to raise and lower the second leg assembly and is rotatable about a fourth axis of rotation to move the second leg assembly toward or away from the midsagittal plane. The back section is movable relative to the seat section to move the back section between a bed position and a chair position.

The controller can command one or more drive mechanisms to move at least one of the seat section, the first leg assembly, the second leg assembly, or the back section. The controller can be programmed to cause the apparatus to move between two or more preset configurations. The preset configurations can include a chair configuration, a bed configuration, and a leg assemblies configuration (e.g., an opened configuration, a widened configuration, and a spread configuration). Additionally or alternatively, portions of the apparatus can be moved between non-preset configurations to provide flexibility.

In some embodiments, an apparatus for positioning a subject for tattooing can include a seat section, leg assemblies, and means for moving the leg assemblies. In one embodiment, a controller can be in communication with the means for moving the leg assemblies and can be programmed to individually control movement of each leg assembly. In one embodiment, the means for moving the leg assemblies can include, without limitation, one or more motors, electrical drive mechanisms, pneumatic drive mechanisms, hydraulic drive mechanisms, rail systems, pistons, linkages, etc. Electronic drive mechanisms can include electrically driven linear actuators, electronic actuators, and other electronically articulatable devices. Pneumatic drive mechanisms can include pneumatically driven linear actuators, pneumatic actuators, and other pneumatically articulatable devices.

The means for moving the leg assemblies can include one or more hinges connecting the leg assemblies to the seat section or other component. In one embodiment, one hinge connects one leg assembly to the seat section and another hinge connects another leg assembly to the seat section. Each of the hinges can define an axis of rotation. The axes of rotation can be generally parallel to one another or at another desired orientation. Other types of mounting components or arrangements can be used to provide desired motion of the leg assemblies.

In some embodiments, an apparatus for positioning the subject during tattooing can include a back section, a seat section, leg assemblies, and an electronic drive mechanism. The leg assemblies are movable between different positions, such as forward positions, closed positions, lateral positions, open positions, or other positions. The leg assemblies in a forward position can be positioned generally in front of the seat section to support the subject's legs while the subject sits on the seat portion and while the subject's back is against the back section. The leg assemblies in the lateral position can be located at the sides of the seat section. For example, each of the leg assemblies can be subjacent to a lateral side of the seat assembly. The electronic drive mechanism can be operable to reconfigure the apparatus between different configurations, including a chair configuration, a bed configuration, a straddling configuration (e.g., a configuration suitable for straddling by the client), or the like.

The electronic drive mechanism can have an opening mode for moving the leg assemblies away from a plane (e.g., a midsagittal plane or a centerplane) of the apparatus and a closing mode for moving the leg assemblies towards the plane. When the leg assemblies are closed, they can be adjacent to one another and located on opposite sides of the plane. When the leg assemblies are opened (e.g., at a lateral position), they can be positioned generally along a frontal or coronal plane. In one embodiment, the controller can command one or more motors of the electronic drive mechanism to translate, rotate, and/or otherwise move sections, such as leg assemblies. The electronic drive mechanism can have various modes, including a raising/lowering mode for vertically moving the seat section, a back adjust mode for rotating the back section relative to the seat section, and/or an opening/closing mode for rotating one or more of the leg assemblies.

The foregoing is a summary and thus contains, by necessity, simplifications, generalizations and omissions of detail. Those skilled in the art will appreciate that the summary is illustrative only and is not intended to be in any way limiting.

DETAILED DESCRIPTION

Figure 1:
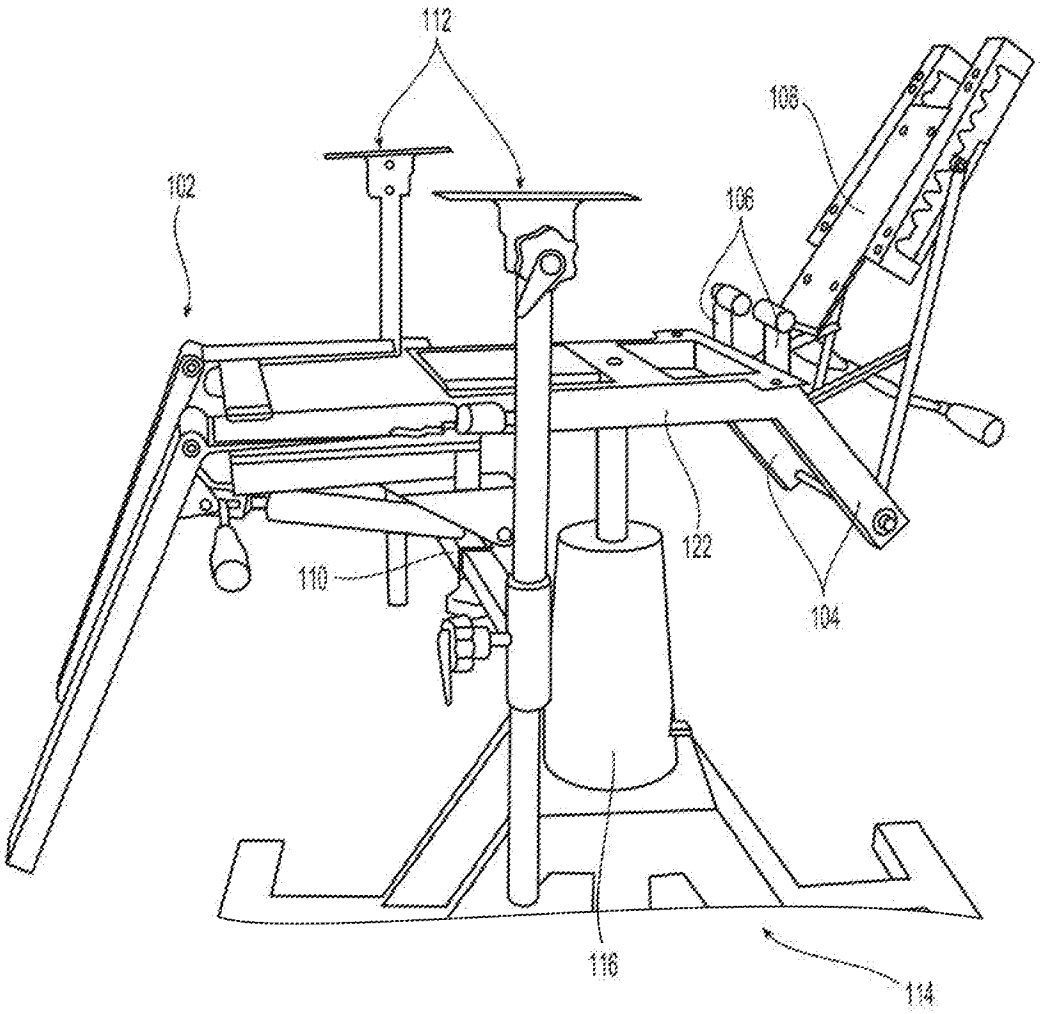
FIG. 1 is a side view of an exemplary frame for an apparatus in a bed configuration.
Figure 2:
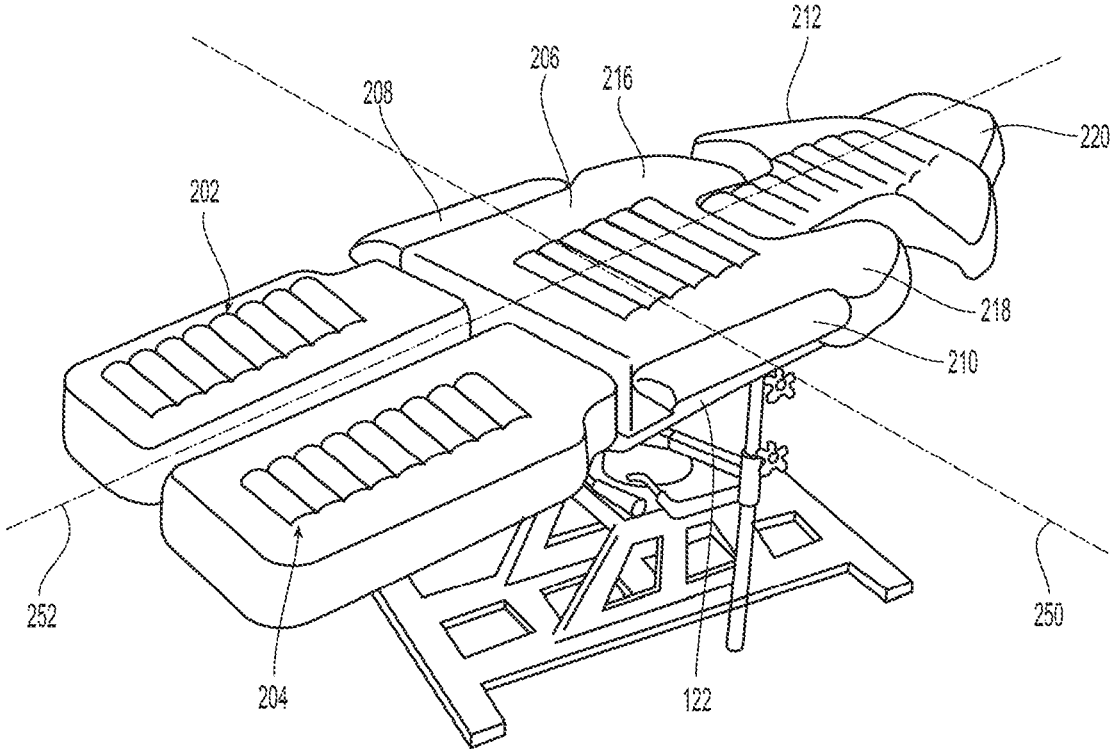
FIG. 2 illustrates an exemplary apparatus in a bed configuration.

FIG. 1 illustrates an exemplary apparatus frame 122 of an apparatus in a chair configuration for supporting a person in a sitting position. FIG. 2 illustrates an apparatus with the frame 122 positioned in a bed configuration to support a person lying down. Referring now to FIG. 1, the frame 122 can include a generally flat portion that is parallel to the ground, which is also known as the transverse plane (e.g., the plane that divides the apparatus into top and bottom sections). As shown by the figure, and described in more detail below, a front portion of frame 122 can be "T" shaped to support leg assemblies 102 configured to independently rotate away from a position generally parallel to the midsagittal plane, i.e., a plane passing through the middle of the apparatus dividing it into left and right portions, to positions generally perpendicular to the midsagittal plane. The illustrated support leg assemblies 102 are in a forward position to support a client's legs when the client is in a sitting position.

The front portion of the frame 122 can be separated from a back portion by the frontal plane (i.e., a plane that divides the apparatus into front and back portions). In an exemplary embodiment, a back portion of frame 122 can be formed to include one or more rear-downward angled support members 104 and upwardly extending support sections 106 that are configured to connect to an L-hinge 108, which can be coupled to the back section. As will be described in more detail below, the back section can be articulated.

In the illustrated exemplary embodiment, a horizontal tubular rail 110 (e.g., a steel rectangular tube, a circular tube, etc.) can be coupled to the bottom of frame 122 extending in a direction parallel to the transverse and frontal planes. The horizontal tubular rail 110 can be used to attach arm bar assemblies 112. In at least one exemplary embodiment, the arm bar assemblies 112 can be articulated such that each assembly can be independently moved linearly in one or more directions (e.g., a direction that is perpendicular to the midsagittal plane). In an exemplary embodiment, the arm bar assemblies 112 can also be articulated such that the arm supports are positioned about an axis parallel to the transverse plane and the midsagittal plane.

FIG. 1 shows a chassis 114 coupled to the bottom of frame 122. Frame 122 can rotate about the chassis 114 such that it rotates about, for example, the vertical axis (i.e., an axis parallel to the midsagittal plane and the frontal plane). In at least one exemplary embodiment, the chassis 114 can be coupled to a hydraulics assembly 116, which can be used to raise and lower the frame 122. The frame 122 can be linearly moved through the transverse plane in an exemplary embodiment. In other embodiments, an electromechanical assembly can be used to position (e.g., raise, lower, tilt, etc.) the lower frame 122. The electromechanical assembly can include one or more electrical drive mechanisms operable to move the lower frame 122.

Turning now to FIG. 2, the apparatus can include supporting sections coupled to the frame 122. The leg sections 202 and 204, arm sections 208 and 210, seat section 206, back section 212, and head rest 220 are flush with seat section 206, together forming a generally flat surface for a client to lie on. In this exemplary embodiment, the frame 122 is generally covered with the supporting sections. In some embodiments, the frame 122 can be integrated into the sections. FIG. 2 shows an axis parallel to both the midsagittal plane and the transverse plane 252. This axis is formed by the midsagittal plane cutting through the apparatus and separates the right from left side. Also shown is an axis parallel to both the frontal plane and the transverse plane 250. This axis is formed by the frontal plane cutting through the apparatus and separates the front from the back.

Briefly, the seat section 206 can include top and bottom portions separated by a plane parallel to the transverse plane, forward and rearward portions separated by a plane parallel to the frontal plane, and left and right portions separated by a plane parallel to the midsagittal plane. Seat section 206 can include a bacteria-resistant fabric cushion filled with foam padding or the like. The bottom of seat section 206 can be operatively coupled to frame 122 via one or more bolts, screws, pins, buttons, nails, adhesives, etc.

Back section 212 is also shown. Back section 212 can also include a bacteria-resistant fabric cushion filled with foam padding or the like. As is described in more detail below, back section 212 can be operatively coupled via one or more bolts, screws, pins, buttons, nails, adhesives, etc., to a hinge. In an exemplary embodiment, the hinge can be L-shaped. In another exemplary embodiment, back section 212 can be coupled to seat section 206 via a hinge. In this manner, back section 212 can be carried by seat section 206.

In exemplary embodiments, the back section 212 can be formed into a variety of shapes in order to support a client's back in the bed and chair configurations, and to allow a user to straddle it. In this exemplary embodiment, the proximal portion of back section 212 can be narrower than the distal portion in order to define leg openings. The leg openings can be formed by removing different types of shapes from back section 212, such as, for example, plano-concave cuts, incurvation-shaped cuts, generally rectangular, generally circular, generally oval, or generally square cuts, or cuts defined by a tapering from the proximal end of the back section to the distal end. In at least one exemplary embodiment, the back section could be generally "T" or "Y" shaped.

As stated briefly above, the back section 212 can be rotatably coupled to, for example, the rear portion of seat section 206 or a hinge coupled to frame 122. One exemplary coupling is described in more detail in connection with FIGS. 4 and 5. The coupling that attaches the proximal portion of back section 212 can be used to reconfigure the apparatus from a bed position (shown in FIG. 2) to a chair position (shown in FIG. 6). For example, a user could rotate back section 212 from the position illustrated in FIG. 2 to the position illustrated in FIG. 6 by rotating back section 212 from a position in which back section 212 is flush with seat section 206 (i.e., parallel to the transverse plane) to a position in which back section 212 is generally perpendicular to seat section 206 (i.e., generally parallel to the frontal plane).

Turning to leg sections 202 and 204, these sections can also be formed from bacteria-resistant fabric cushions filled with foam padding or the like. As described in more detail below, leg sections 202 and 204 can be operatively coupled to the forward portion of seat section 206 or coupled to frame 122. In an exemplary embodiment, leg sections 202 and 204 can be coupled to rotatable assemblies that can independently rotate the leg sections 202 and 204 about an axis parallel to the transverse and frontal planes. Or put another way, leg sections 202 and 204 can independently rotate from a position generally flush with seat section 206 (e.g., the position shown in FIG. 2) to a position generally perpendicular to a plane formed by the seat section 206 (e.g., similar to the position shown in FIG. 6).

Figure 16:
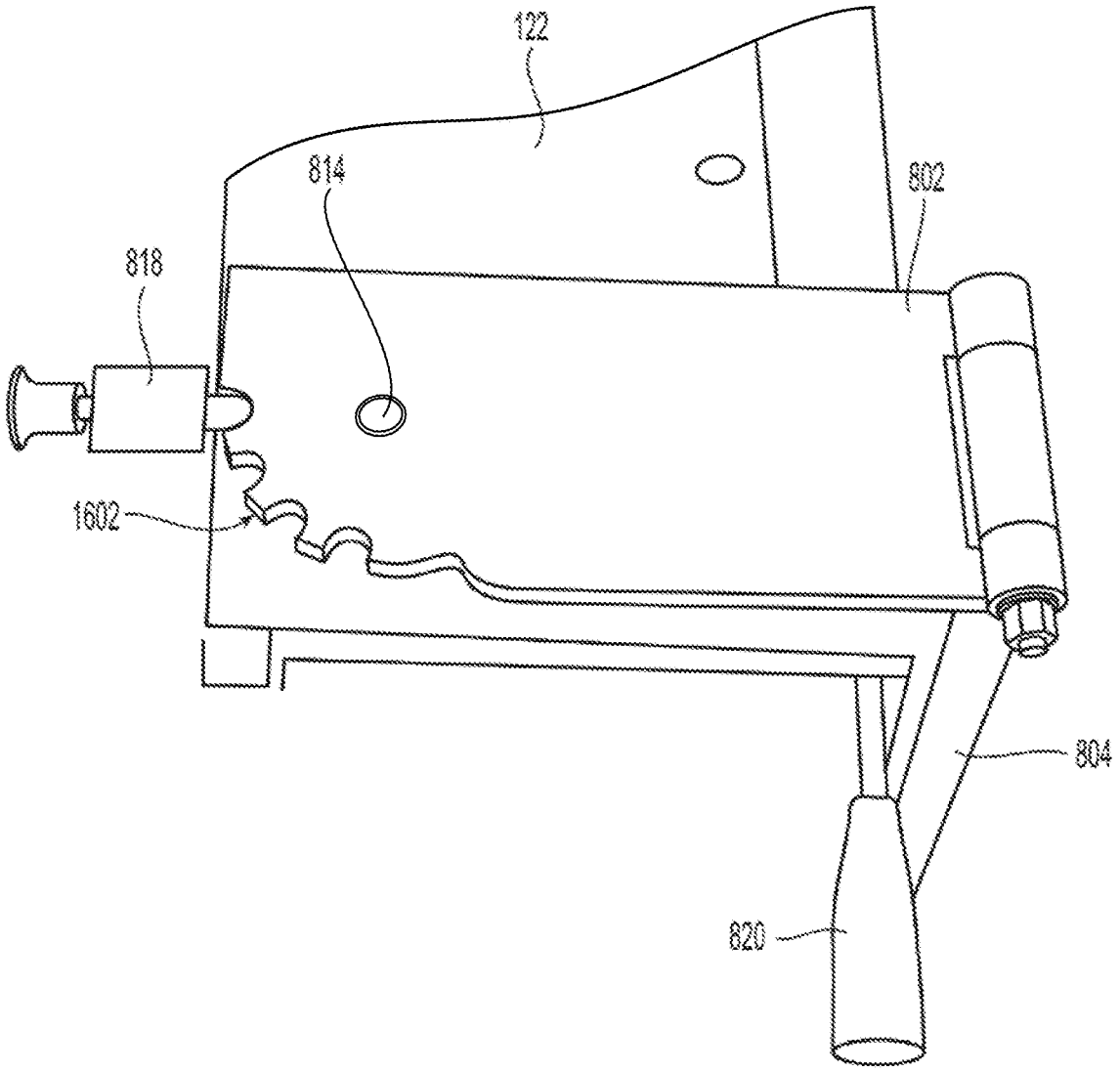
FIG. 16 illustrates a top view of a front portion of an exemplary frame of an apparatus.
Figure 17:
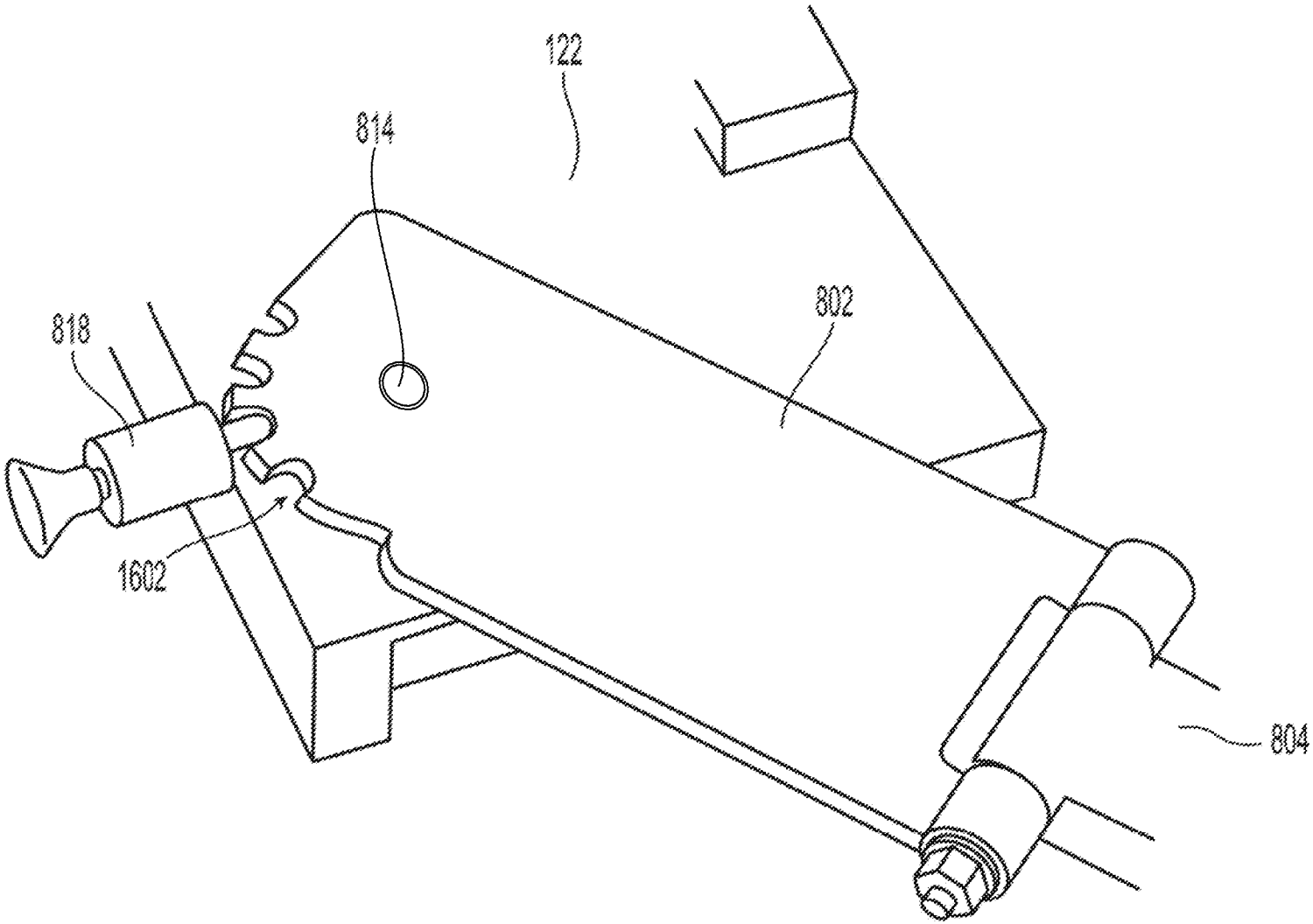
FIG. 17 illustrates an over-the-head view of a front of an exemplary frame of an apparatus.

In at least one embodiment, leg sections 202 and 204 can also be rotated about the vertical axis (i.e., parallel to the frontal and midsagittal planes). Or put another way, in an exemplary embodiment, each leg section 202 and 204 can be independently rotated from the position shown in FIG. 6 to the position shown in FIG. 18. One exemplary rotatable coupling is shown by FIGS. 16 and 17; however, other couplings can be used.

Continuing with the description of FIG. 2, the cuts that define the leg openings are shown as generally adjoined with rearwardly extending leg supports 216 and 218. In an exemplary embodiment, the rearwardly extending leg supports 216 and 218 can have a shape similar to the shape of the openings or can be cut out of back section 212. For example, if the openings or cuts are square-like, rearwardly extending leg supports 216 and 218 can be formed to be square-like. If the cuts are plano-concave shaped, rearwardly extending leg supports 216 and 218 can be formed to be plano-convex shaped. As shown by the figure, the rearwardly extending leg supports 216 and 218 do not need to completely fill the area made by cuts that define the leg openings. The rearwardly extending leg supports 216 and 218, for example, may only fill enough of the openings so that a client can lie flat on the apparatus in the bed configuration.

Figure 3:
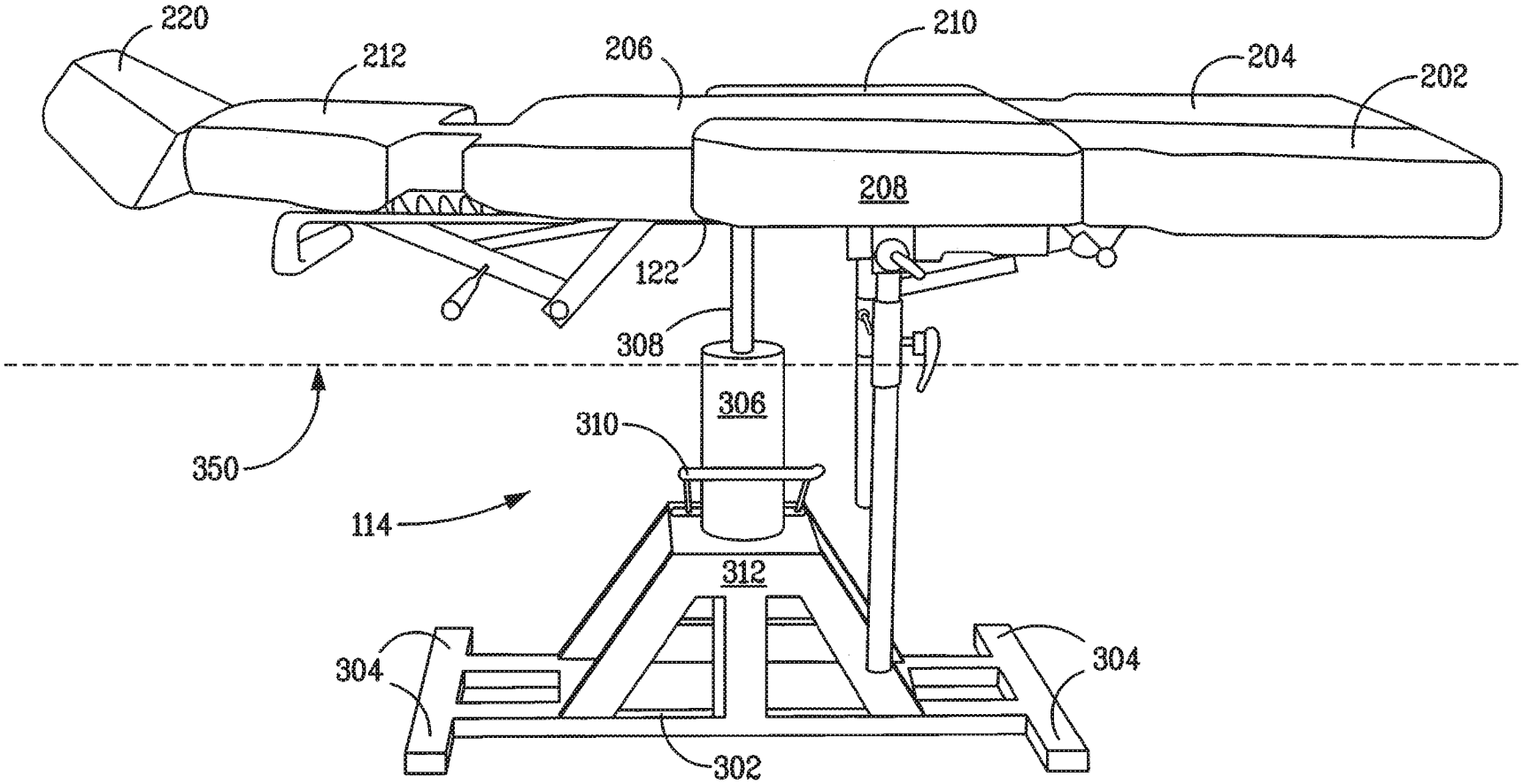
FIG. 3 illustrates a side view of an exemplary apparatus in a bed configuration.

FIG. 3 is a side view of the exemplary apparatus in a bed configuration illustrating an exemplary chassis 114. This view illustrates more clearly an axis 350 that is parallel to both the transverse plane and the frontal plane. The exemplary axis 350 separates the apparatus into top and bottom sections. As shown by the figure, in an exemplary embodiment, chassis 114 can include a support plate 302 that can lie on the floor. In this embodiment, chassis 114 can be bolted to the floor, for example. Support plate 302 can be made from any suitable material such as wood or steel. As illustrated by the figure, in at least one embodiment, support plate 302 can be constructed to increase stability and to aid in the process of applying a tattoo. For example, and as illustrated by the figure, support plate 302 can be formed with stabilizer plate sections 304 that extend in the transverse plane, perpendicular to the midsagittal plane, from the ends of support plate 302 to allow chassis 114 to support a wider or longer load. For example, the stabilizer plate sections 304 can help prevent the apparatus from flipping over when the apparatus is rotated about the vertical axis (e.g., an axis parallel to the midsagittal plane and the frontal plane). The illustrated configuration of support plate 302 can aid in the process of applying a tattoo because the tattoo artist can maneuver a chair closer to the apparatus than he or she would be able to if the support plate was wider. This configuration allows for a tattoo artist to sit in a more comfortable position while he or she is working.

Continuing with the description of the figure, chassis 114 can include a frustum section 312 coupled to support plate 302. As shown by the figure, frustum section 312 can be configured to provide clearance for the arm assemblies as they rotate about a vertical axis (e.g., an axis parallel to the midsagittal plane and the frontal plane) when seat section 206 is rotated. A hydraulics system 306 can be attached to an upper portion of frustum section 312. Release lever 310 can be used to lower and raise shaft 308. In an exemplary embodiment, the top of seat section 206 can be approximately 29 inches off the ground when the hydraulics system 306 is at its lowest position. When hydraulics system 306 is engaged, it can raise shaft 308 approximately 7 more inches to 36 inches. Thus, in exemplary embodiments, the height of the apparatus may be adjusted to allow for the tattoo artist to orient a client in an ergonomically correct position. As one of skill in the art can appreciate, these exemplary values are for illustration purposes only and can be adjusted based on the height that hydraulics system 306 can raise the apparatus, the height of frustum section 312, the materials used to construct the apparatus, the length of the apparatus in the bed configuration, and the width of the apparatus.

Figure 4:
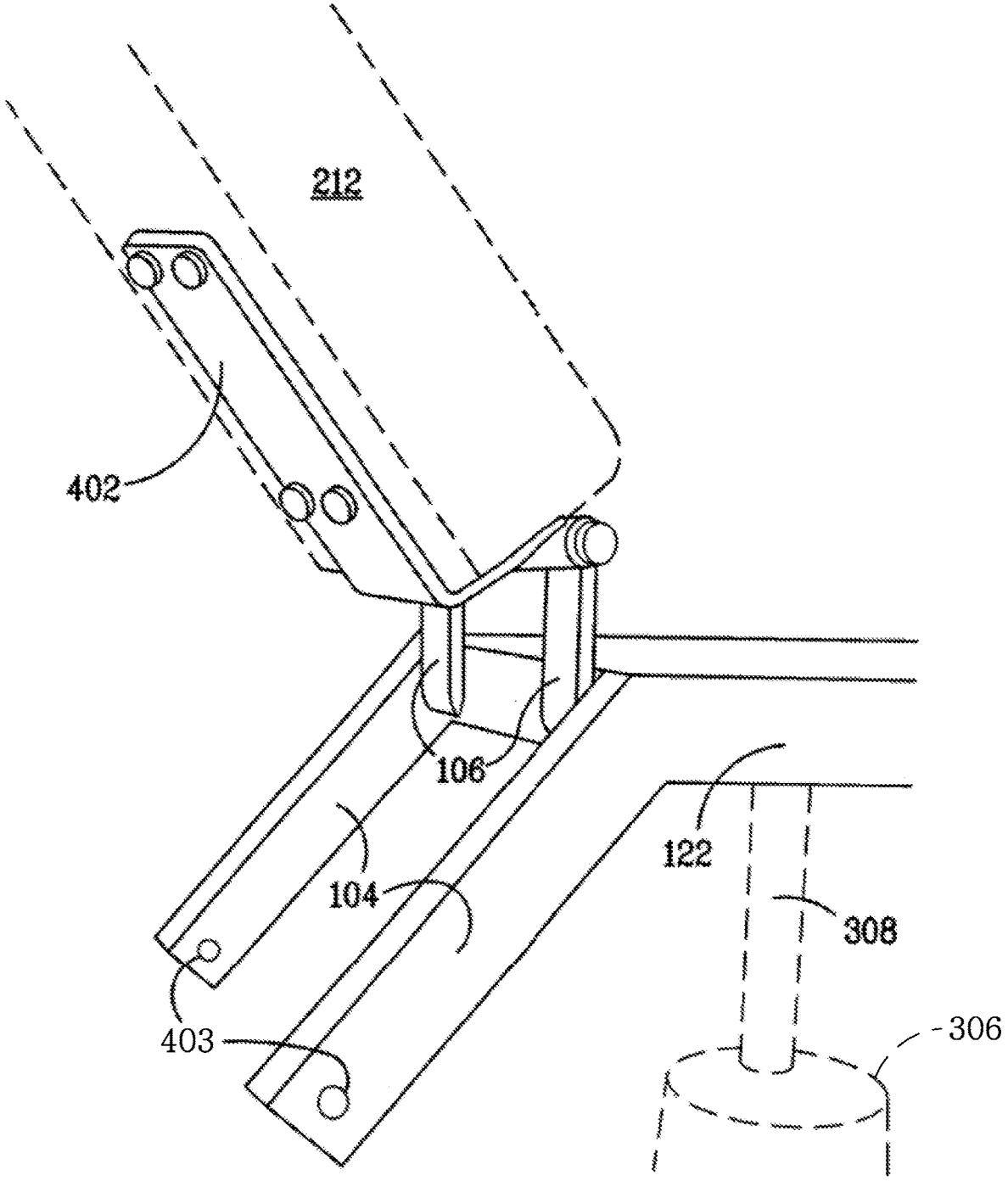
FIG. 4 illustrates a side view of a back portion of an exemplary frame of an apparatus.

FIG. 4 illustrates a view of the rear portion of frame 122 without seat section 206 attached. Back section 212 and hydraulics system 306 are illustrated in dashed lines so that the rear portion of frame 122 can be easily illustrated. In an exemplary embodiment, the back portion of back section 212 can be attached to an L-shaped hinge 402 via one or more bolts or pins.

In an alternative embodiment, a generally flat plate connected to a hinge can be used instead of L-shaped hinge 402. In this exemplary embodiment, the length of upwardly extending support sections 106 and/or the thickness of seat section 206 can be adjusted such that when back section 212 is in the bed configuration, the back section 212 is flush with seat section 206. In another exemplary embodiment, seat section 206 can be coupled to back section 212 via a hinge (not illustrated). In this embodiment, both back section 212 and seat section 206 may be directly connected to each other.

Returning to the exemplary embodiment illustrated in FIG. 4, L-shaped hinge 402 can be coupled to one or more upwardly extending support sections 106 on the back of the portion of frame 122. L-shaped hinge 402 in this example can be configured to rotate back section 212 from the bed configuration to the chair configuration. That is, L-shaped hinge 402 can rotate back section 212 about an axis parallel to the transverse and frontal planes. As can be understood from the illustration, the length that upwardly extending support sections 106 extend can be dependent on the thickness of back and seat sections (212 and 206) so that when back section 212 is parallel to the transverse plane, back section 212 is level with seat section 206. In an exemplary embodiment, back and seat sections (212 and 206) can be approximately 4 inches thick. In this exemplary embodiment, upwardly extending support sections 106 may extend approximately 2 inches upward.

Continuing with the description of FIG. 4, frame 122 can also include one or more rear-downward angled support members 104. As illustrated in FIG. 4, in an exemplary embodiment, each rear-downward angled support member 104 can be configured such that it intersects a plane parallel to the transverse plane at a 45 degree angle; however, the disclosure is not limited to such a configuration, and rear-downward angled support members 104 can be at any angle relative to the transverse plane. Moreover, while two rear-downward angled support members 104 are illustrated, any number of rear-downward angled support members 104 can extend from the flat portion of frame 122. As one skilled in the art can appreciate, frame 122 can be formed to include rear-downward angled support members 104 and upwardly extending support sections 106; however, other embodiments are contemplated. For example, upwardly extending support sections 106 could be attached to frame 122 via one or more bolts or screws, nails, adhesives, etc., or may be welded to frame 122. Moreover, rear-downward angled support members 104 could also be separate components that are attached to frame 122 via one or more bolts or screws, nails, adhesives, etc., or may be welded to frame 122.

In an exemplary embodiment, rear-downward angled support members 104 can be used to couple a support bar operable to lock back section 212 in one or more positions to frame 122. For example, and as illustrated in more detail in FIG. 5, circular holes 403 can be drilled into the distal end of rear-downward angled support members 104. Axles or the like can be used to rotatably couple a support bar (e.g., a square or rectangular shaped bar) to frame 122.

Figure 5:
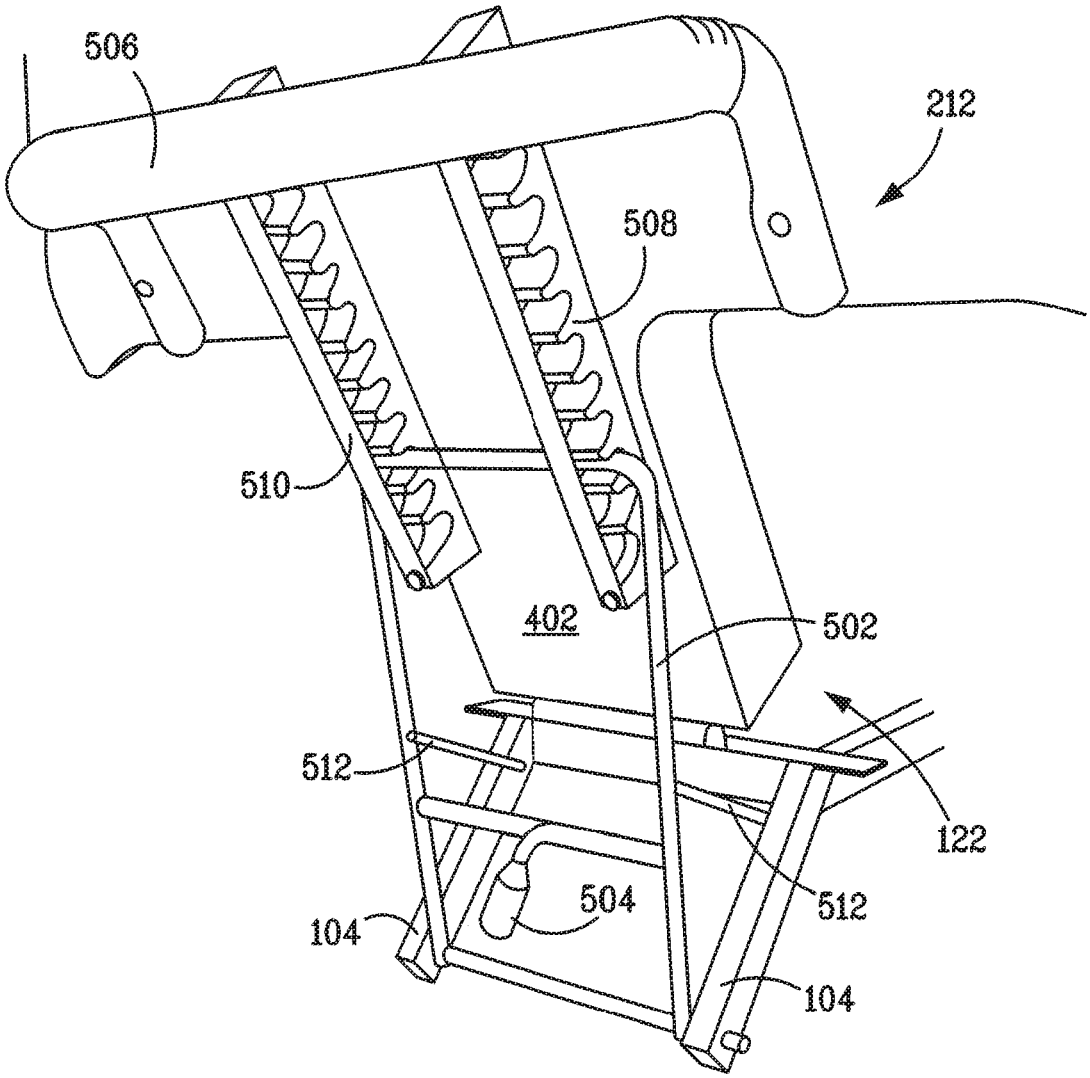
FIG. 5 shows a back portion of an exemplary apparatus.

Turning to FIG. 5, support bar 502 is shown operatively coupled to frame 122 via rear-downward angled support members 104. As shown by the figure, gear rails 508 can be coupled to the back side of back section 212. In an alternative embodiment, gear rails 508 can be coupled to L-shaped hinge 402. A distal end of support bar 502 can be formed to be parallel to the transverse plane and can engage the teeth of gear rails 508. In an example, gear rails 508 can be made of a suitable material such as stainless steel and can have associated catch lock rails 510 attached in order to prevent support bar 502 from disengaging. Tension springs 512, which are designed to absorb and store energy as well as create a force that pulls support bar 502 toward frame 122, can attach frame 122 to support bar 502. In exemplary embodiments, the initial tension force can be set based on the angle rear-downward angled support members 104 form with frame 122, the weight of the support bar 502, and the weight of back section 212, for example. Also shown is a handle 506, which can be used to rotate the apparatus about chassis 114 (not shown).

In operation, a tattoo artist can adjust the angle that back section 212 forms with seat section 206 (not shown) by using a handle 504 to adjust which set of teeth support bar 502 engages. As one of skill in the art can appreciate, in an alternative embodiment, handle 504 can be mounted on the bar portion of support bar 502 to provide a larger torque force when the bar is moved from tooth to tooth. When support bar 502 engages the teeth of gear rails 508 closest to the proximal end of the back section 212, back section 212 will be generally perpendicular to the transverse plane. When support bar 502 engages the teeth of gear rails 508 closest to the distal end of the back section 212, back section 212 will be generally flush with seat section 206.

Figure 6:
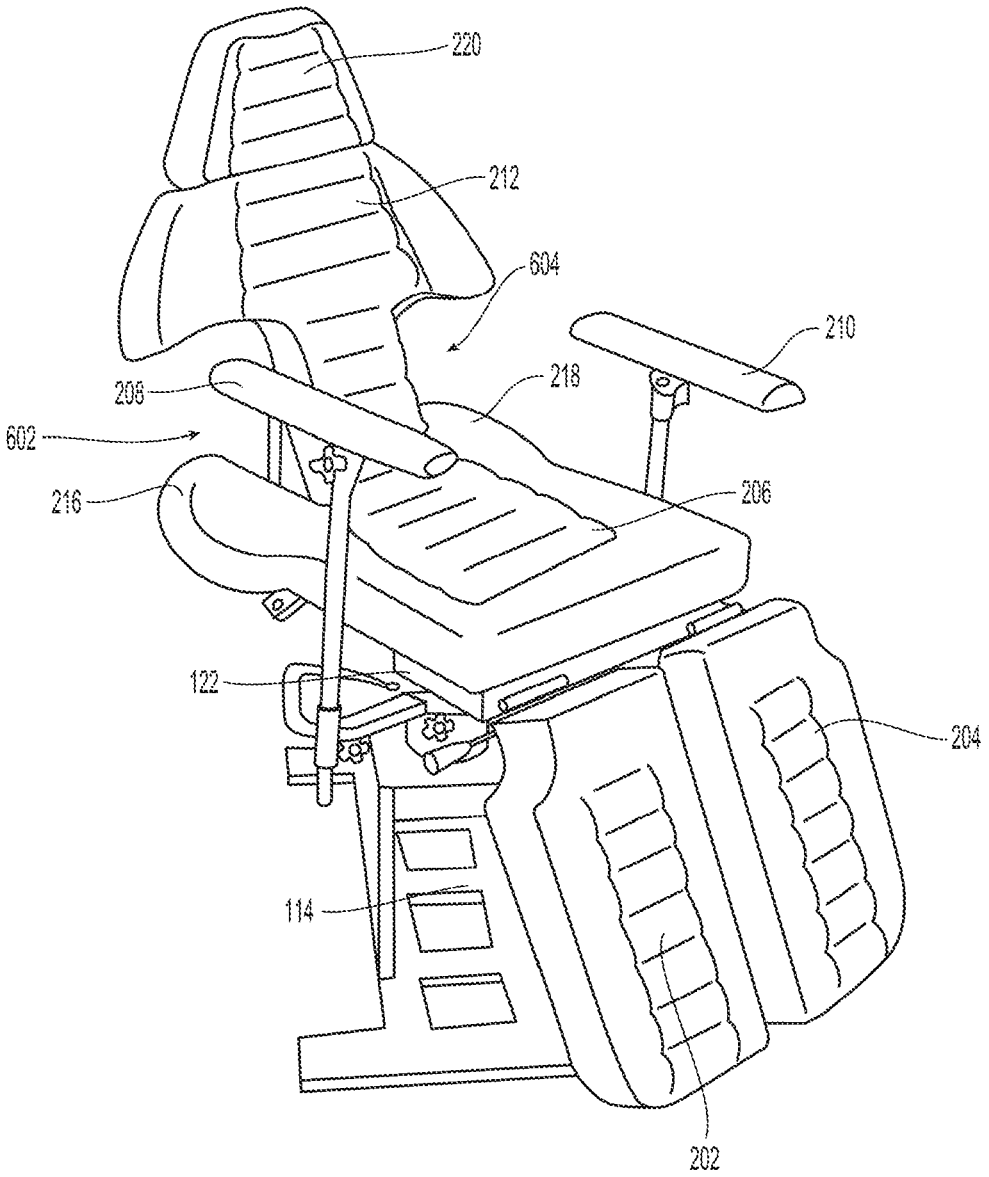
FIG. 6 is an isometric view of an apparatus in a chair configuration in accordance with one embodiment.

FIG. 6 is an isometric view of the exemplary apparatus in a chair configuration. As shown in the figure, arm sections 208 and 210 are raised up from the position illustrated in FIG. 2, and seat section 206 is rotated a quarter turn counterclockwise about the vertical axis (i.e., parallel to the midsagittal and frontal planes). In the figure, back section 212 has been rotated about an axis parallel to the transverse and frontal plane approximately 60 degrees upward from a plane that is transverse to the apparatus. In this configuration, cuts 602 and 604 defining leg openings are clearly shown. In this configuration, a client could sit rearward with his or her chest resting against back section 212 and insert his or her legs into openings defined by the cuts 602 and 604.

Figure 7:
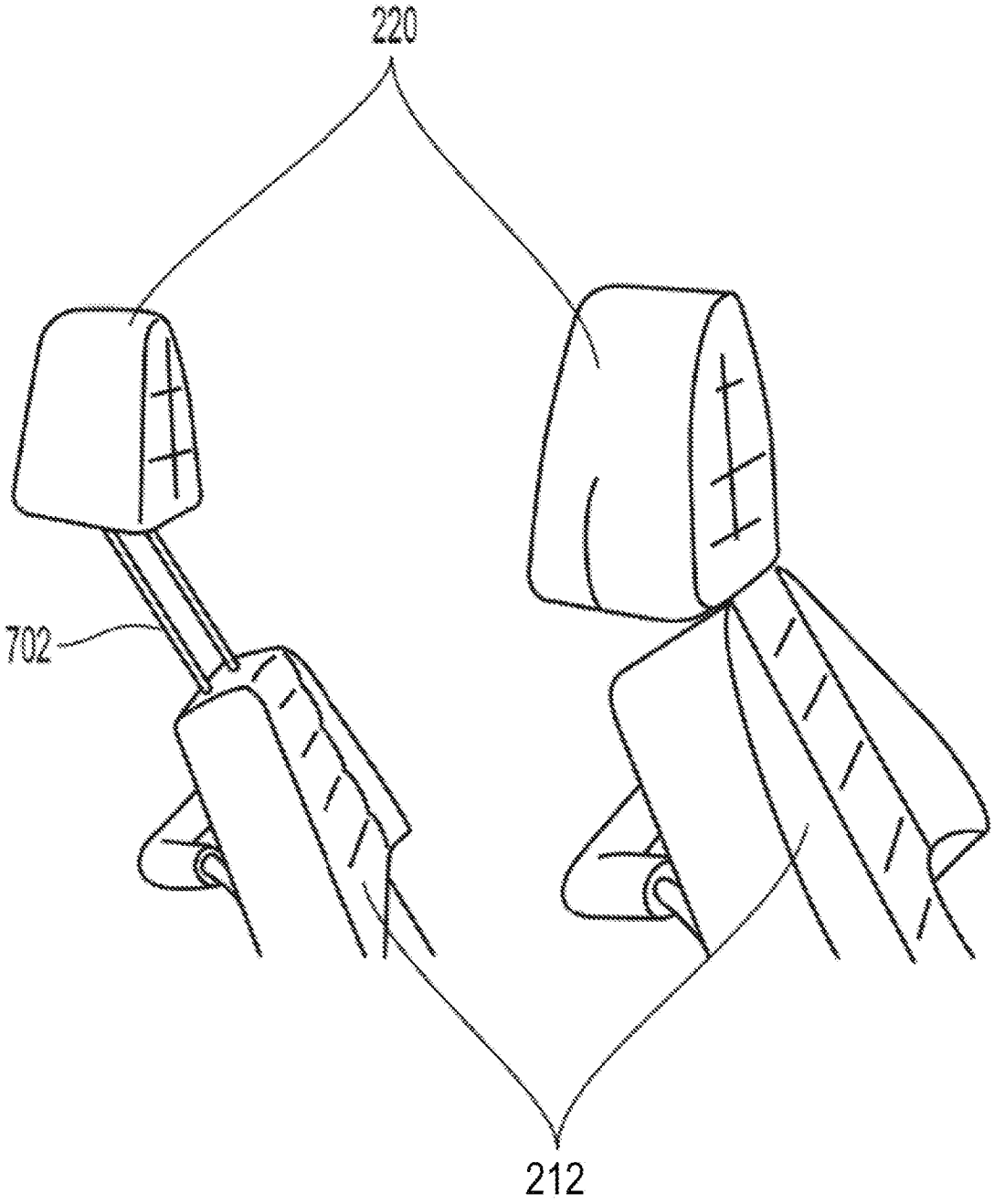
FIG. 7 illustrates side views of an exemplary back section with a headrest in raised position and a lowered position.

FIG. 7 illustrates side views of an exemplary back section 212 with a headrest 220 in a raised position and a lowered position. As shown by the figure, the position of headrest 220 can be adjusted such that it is extended from back section 212 in order to support a tall client as he or she sits in the apparatus. For example, shafts 702 can be attached to headrest 220 and inserted into holes on the top of back section 212. In at least one embodiment, headrest 220 can be removed from back section 212.

Figure 8:
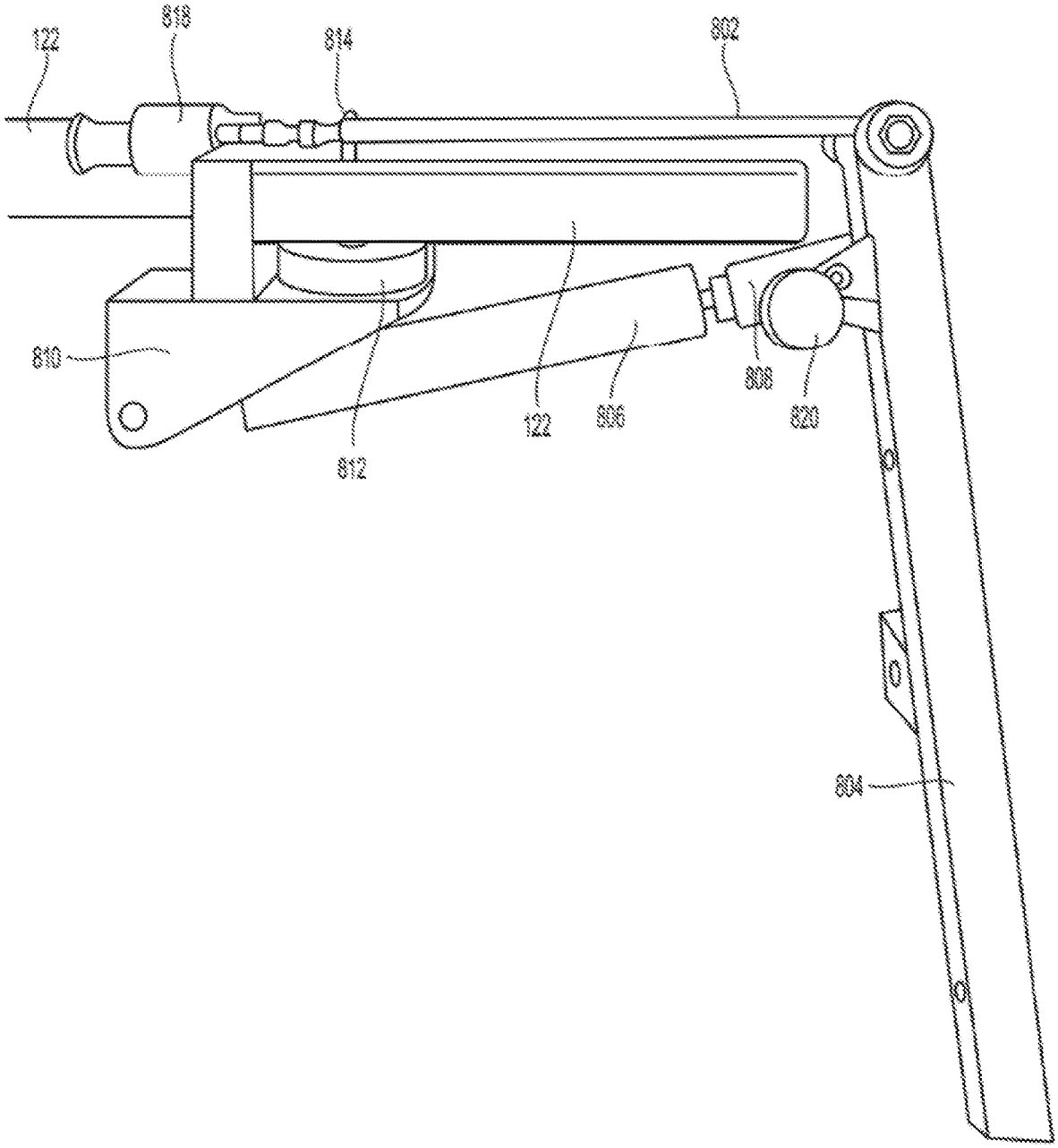
FIG. 8 is a side view of a front portion of an exemplary frame of an apparatus.

FIG. 8 shows a side view of the front portion of frame 122 with an exemplary rotatable assembly that can be used to lift leg section 202 (not shown). While the following discussion will focus on the left side of the apparatus, one of skill in the art can appreciate that the right side can have similar features. Leg support 202 can be coupled to leg frame 804. Leg frame 804 can be made from any suitable material, such as wood or steel. In an exemplary embodiment, leg frame 804 can be rotatably coupled to leg plate 802, which can also be made from any suitable material, such as wood or steel. As illustrated more clearly in FIGS. 16 and 17, the proximal end of leg plate 802 can be gear-shaped and held in place by a spring pin assembly 818. The spring pin assembly 818 can be contracted to allow leg plate 802 to rotate about axle pin 814 in a plane parallel to the transverse plane.

Leg plate 802 can be coupled to the front top portion of frame 122 via axle pin 814 that can extend through frame 122 and is coupled to a top portion of circular support 812. As described in more detail in FIGS. 16 and 17, the circular support 812 can rotate about axle pin 814. The top portion of rear bracket 810 can be attached to the bottom portion of circular member 812. Hydraulics system 806 can be coupled via an axle to the rear portion of rear bracket 810. In this configuration, and as described in more detail in FIGS. 16 and 17, when leg plate 802 is rotated in a plane parallel to the transverse plane, axle pin 814 can rotate rear bracket 810, which in turn rotates hydraulics system 806.

Continuing with the description of FIG. 8, shaft 808 with a bracket attached to the end of shaft 808 can be configured to extend from hydraulics system 806 in order to raise leg frame 804 from the position shown in FIG. 8 to the position shown in, for example, FIG. 2. As shown in FIG. 8, the proximal portion of shaft 808 can be operatively coupled to the hydraulics system 806, and the distal end can be rotatably coupled to leg frame 804 via an axle. In an alternative embodiment, hydraulics system 806 can be reversed such that the shaft 808 can engage the rear bracket 810 instead of the leg frame 804. A release lever 820 can be used to configure hydraulics system 806 to extend or contract shaft 808.

Figure 9:
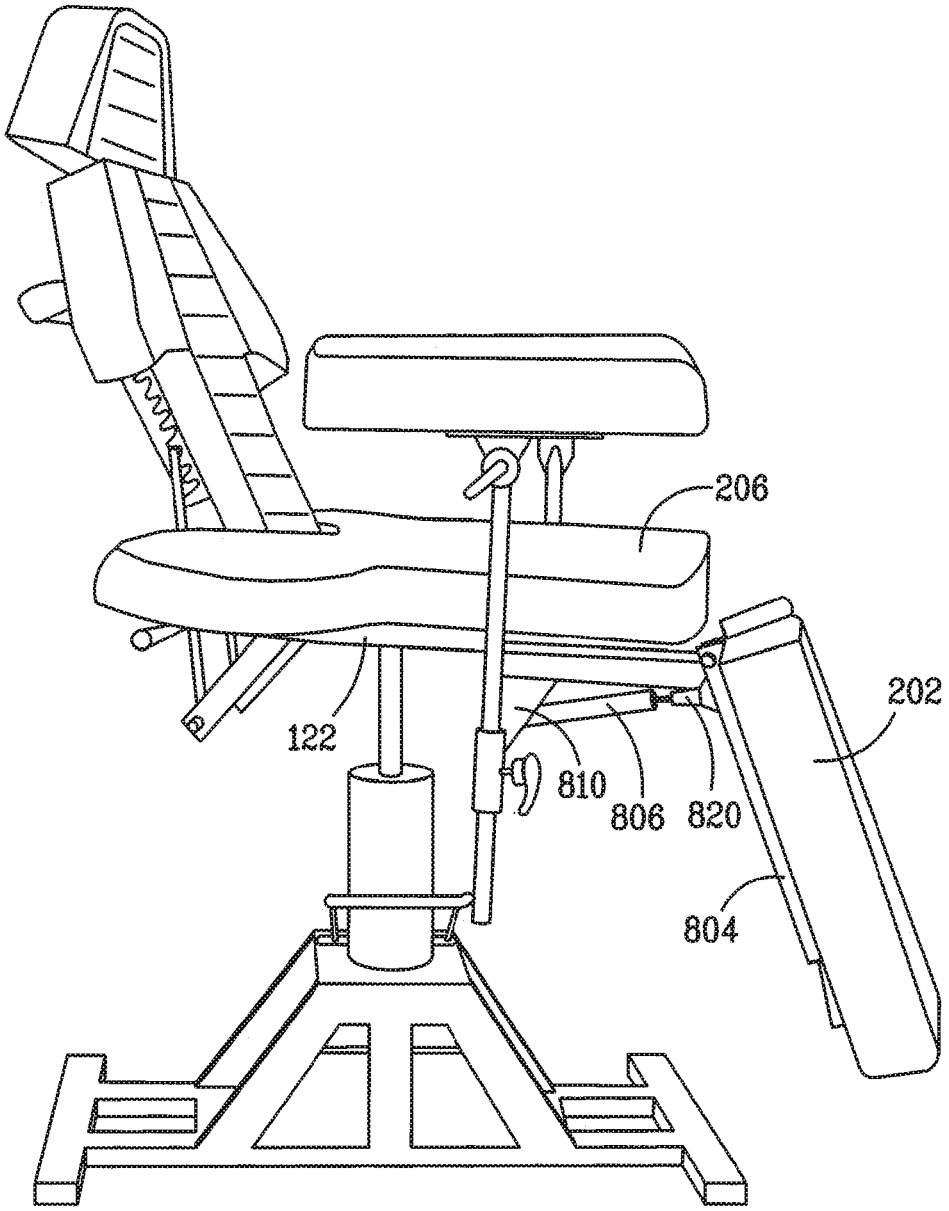
FIG. 9 is a side view of an exemplary apparatus in a chair configuration.

FIG. 9 is a side view of the apparatus in the chair configuration. In the exemplary embodiment, the front portion of frame 122 has an attached rotatable assembly in the same configuration as is illustrated in FIG. 8. In operation, a tattoo artist can engage release lever 820, which can be used to configure hydraulics system 806 to extend or contract shaft 808 (not shown) that can raise or lower leg frame 804 (thereby raising or lowering leg section 202) from a position generally perpendicular to the transverse plane to a position generally parallel to the transverse plane. When moved into the bed configuration, leg section 202 can be generally flush with seat section 206 (similar to leg sections 202 and 204 in FIG. 2).

Figure 10:
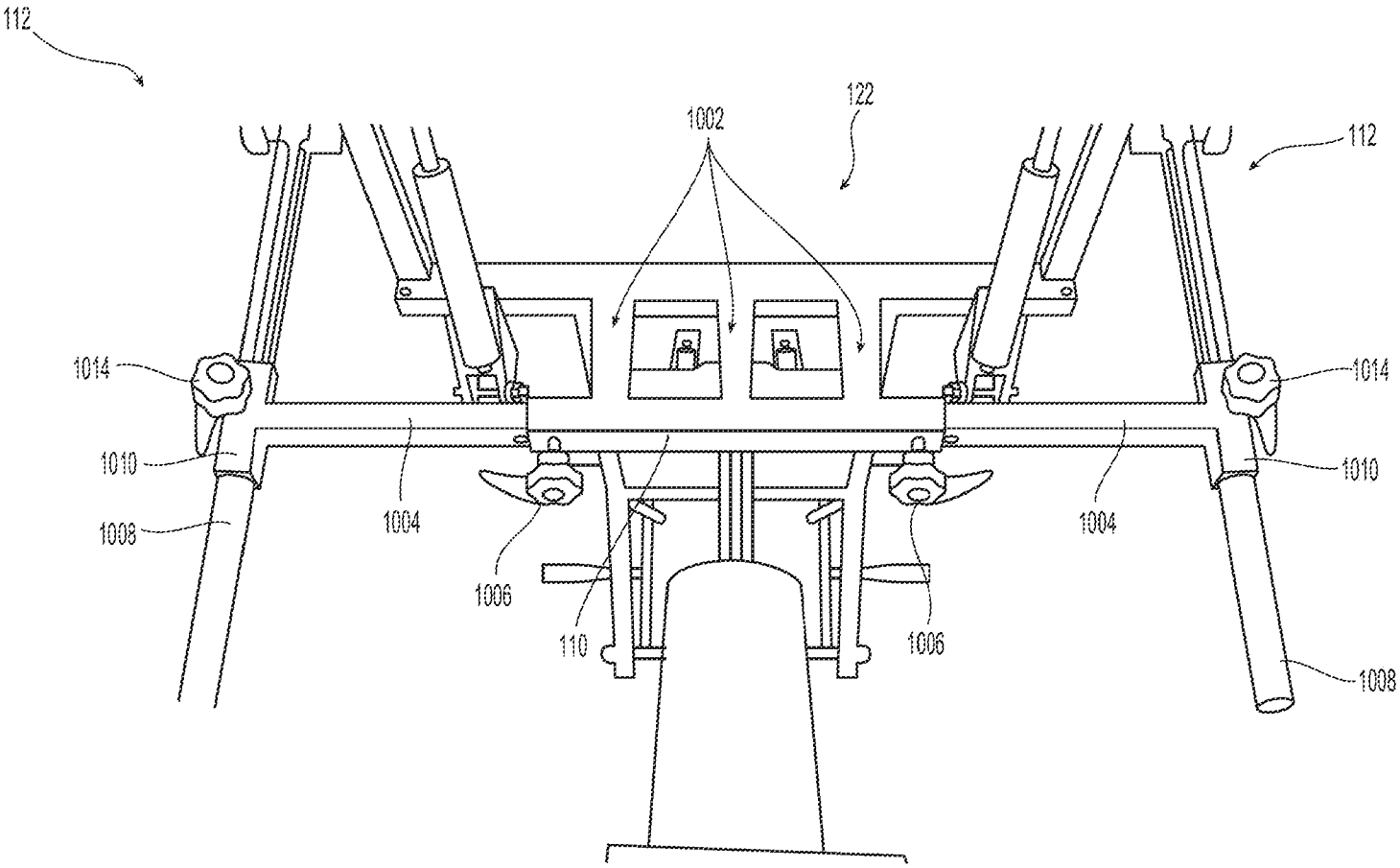
FIG. 10 shows the underneath the front portion of an exemplary frame of an apparatus.

FIG. 10 is a view from the underside of the front portion of frame 122 illustrating how exemplary arm bar assemblies 112 can be coupled to frame 122 in an exemplary embodiment. In this embodiment, the bottom of the frame 122 can include one or more downward extending members 1002 coupled to a horizontal tubular rail 110. On each end of the horizontal tubular rail 110, openings can receive the proximal ends of two shafts 1004 that are part of the arm bar assemblies 112. In the illustrated example, the horizontal tubular rail 110 can be mounted such that the two shafts 1004 can be independently extended in a direction away from the midsagittal plane of the apparatus. That is, the two shafts 1004 can be linearly extended and contracted in the transverse plane. The two shafts 1004 can include vertically extending holes that can be used to secure arm bar assemblies 112 to frame 122. In an exemplary embodiment, screw clamps 1006 can be used to secure the position of shafts 1004; and in at least one embodiment, shafts 1004 can be detached completely. In an exemplary embodiment, horizontal tubular rail 110 can be cylindrical and the shafts 1004 can be rotated within the horizontal tubular rail 110 in order to adjust the position of the arm bar assemblies 112. In this example, shafts 1004 can include a plurality of holes separated from each other not only horizontally, but also around the housing of the cylindrical horizontal shafts. In this configuration, screw clamps 1006 could be used to secure arm bar assemblies 112 from rotating about an axis parallel to the frontal and transverse planes and linearly moving in the transverse plane. For example, in this configuration arm bar assemblies 112 could be independently rotated 360 degrees within the horizontal tubular rail 110 through a plane parallel to the transverse plane of the apparatus.

Continuing with the description of FIG. 10, the distal ends of the horizontal shafts 1004 can include support plates 1010 coupled to vertical shafts 1008 via an axle attached to tension levers 1014, which can be used to lock the vertical shafts 1008 in position. The tension levers 1014 can be used to release the pressure holding vertical shafts 1008 such that the vertical shafts 1008 can be moved in a linear, vertical direction perpendicular to the transverse plane of the apparatus. That is, arm bar assemblies 112 can be raised or lowered by adjusting the position of the vertical shafts 1008.

Figure 11:
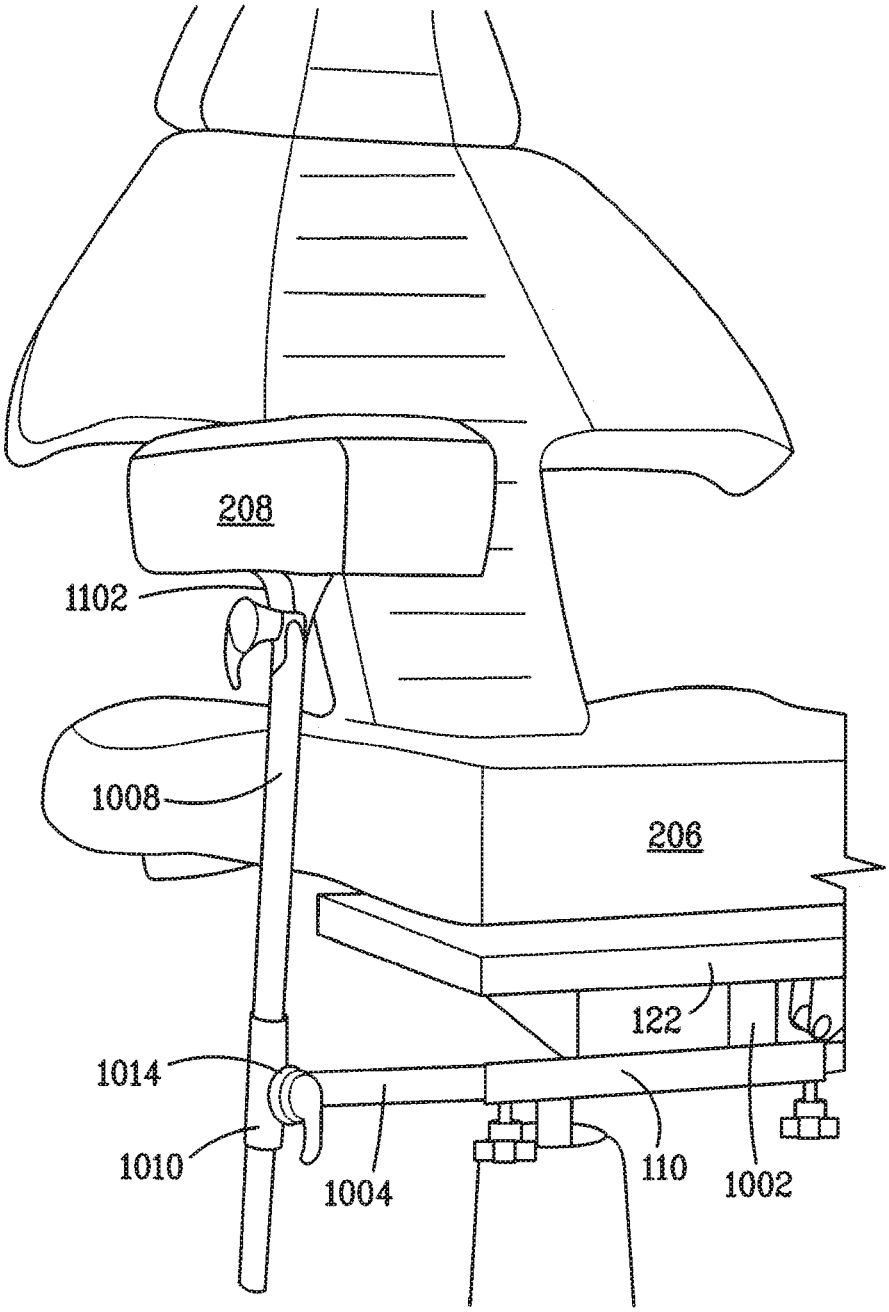
FIG. 11 illustrates a portion of an exemplary apparatus in a chair configuration.

FIG. 11 illustrates the left side of the apparatus in a chair configuration with the legs removed in order to illustrate the left arm assembly. As shown by the figure, arm section 208 can be coupled to vertical shaft 1008 via bracket 1102. In an exemplary embodiment, bracket 1102 can be configured to rotate arm section 208 through a plane parallel to the transverse plane. In an exemplary embodiment, bracket 1102 can be configured to rotate 45 degrees clockwise or counterclockwise, from a position generally parallel with the transverse plane of the apparatus. Or put another way, bracket 1102 can rotate about an axis parallel to the transverse and frontal planes. In this embodiment, a hole can be drilled through shaft 1008 and an axle bolt can couple bracket 1102 to shaft 1008. The position of arm section 208 can be secured by a tension lever 1014 coupled to a support plate 1010 via an axle bolt. When the tension lever 1014 is opened, the pressure on bracket 1102 can be released so arm section 208 can be moved.

Figure 12:
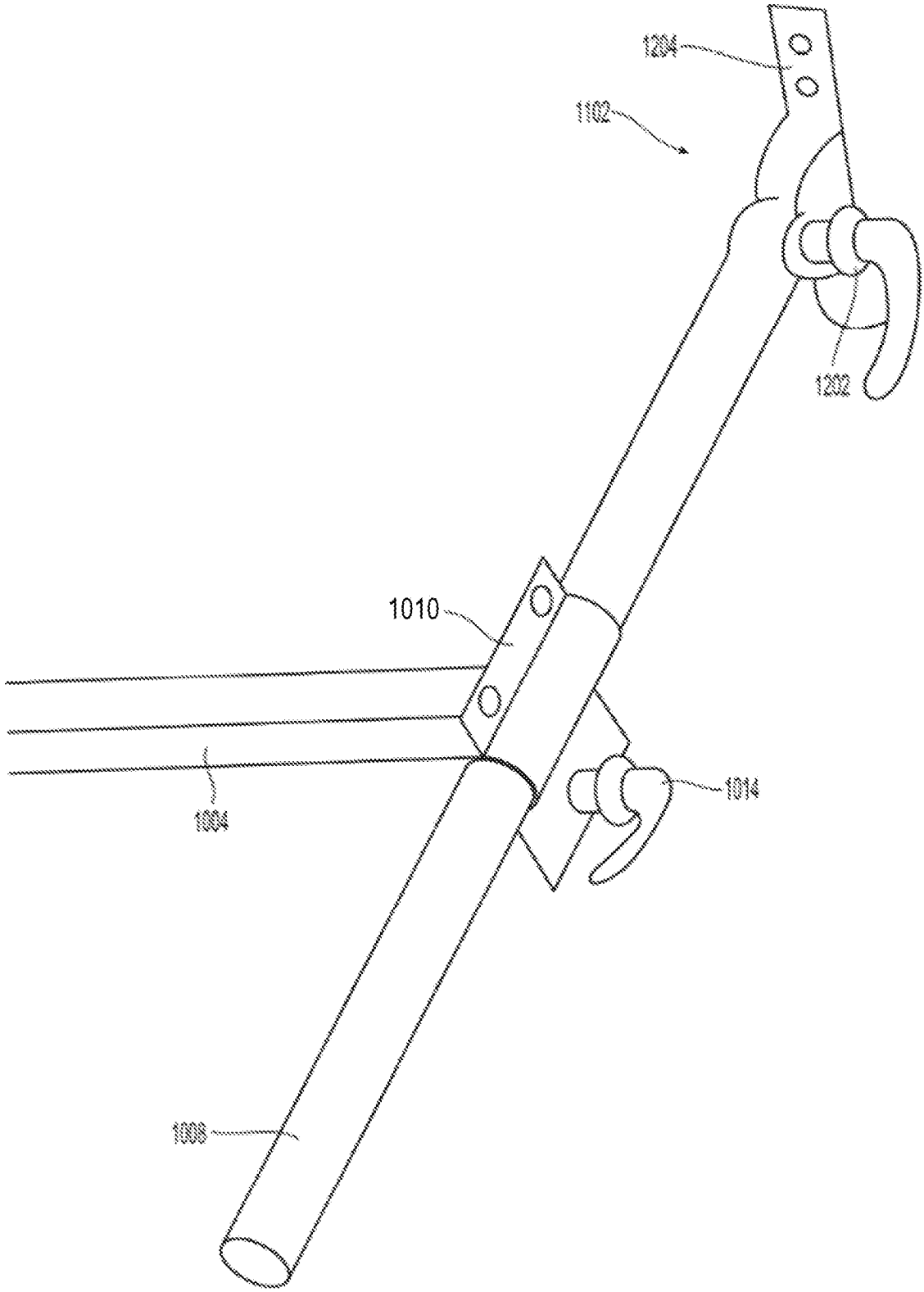
FIG. 12 illustrates an exemplary arm assembly.

An exploded view of an exemplary arm assembly is shown in FIG. 12. In this embodiment, shaft 1008 is shown coupled to horizontal shaft 1004 via support plates 1010. One support plate 1010 can be fixed to the distal end of the horizontal shaft 1004 and the other can be secured to it by bolts and tension applied by tension lever 1014. In this example, the plates can be curved so as to define a tube for vertical shaft 1008 to be inserted. The vertical position of vertical shaft 1008 can be adjusted, and the tension lever 1014 can be used to lock vertical shaft 1008 in position. In addition, when vertical shaft 1008 is generally circular, vertical shaft 1008 can be rotated about an axis passing through the middle of vertical shaft 1008. In this example, arm section 208 (not shown) can be rotated 360 degrees in the tube defined by support plates 1010.

Bracket 1102 can be coupled to one end of vertical shaft 1008 via an axle bolt and a tension lever 1202. In this example, the distal end of the bracket 1102 can include a plate 1204 configured to secure arm section 208. For example, arm section 208 could be coupled to the distal plate 1204 via a bolt. The proximal end of bracket 1102 can be curved to allow for rotational motion about the axle pin securing it to vertical shaft 1008. In operation, a tattoo artist could release tension lever 1202, thereby allowing bracket 1102 to rotate; could position the bracket; and could use the tension lever 1202 to lock bracket 1102 into position.

Figure 13:
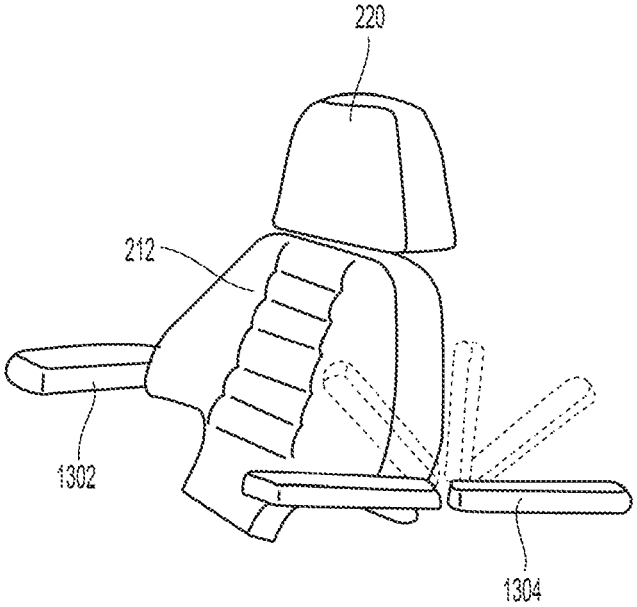
FIG. 13 is a side view of an exemplary back section including exemplary arm frame supports rotatably coupled to the back section.

Referring now to FIG. 13, illustrated is an alternative configuration for back section 212. This exemplary configuration can be used when back section 212 is configured to rotate from a chair configuration to a position substantially 30 degrees from the transverse plane. Thus, back section 212 may not fully recline into the bed configuration in this embodiment. As illustrated by FIG. 13, in this exemplary embodiment, arm frame sections 1302 and 1304 can be rotatably coupled to back section 212. Arm sections similar to arm sections 208 and 210 can be attached to arm frame sections 1302 and 1304. However, in this example, the arm sections can encircle the arm frame sections 1302 and 1304 and can include cushioning for both a top side and a bottom side. As shown by the figure, arm frame sections 1302 and 1304 can be independently rotated from a first position whereby arm frame sections 1302 and 1304 can be used as supports for a person sitting with his or her back against back section 212 clockwise 180 degrees about an axis parallel to both the frontal plane and transverse plane to a second position whereby the arm sections 1302 and 1304 can be used as supports for a person straddling back section 212.

Figure 14:
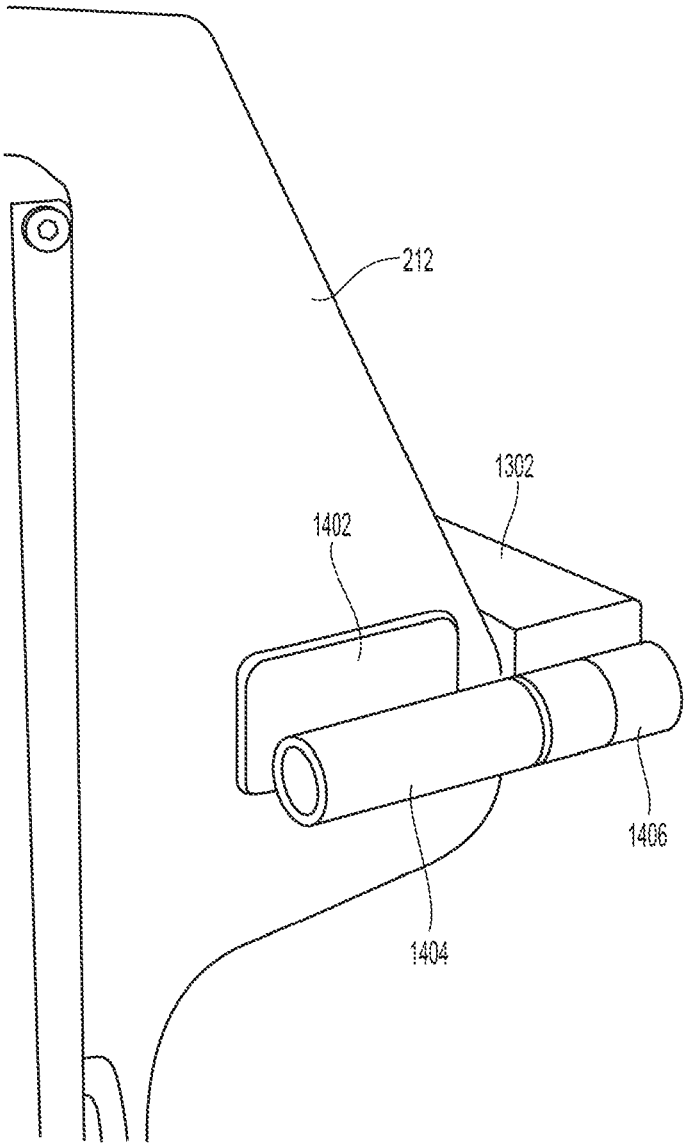
FIG. 14 is a back view of a portion of an exemplary back section.

Turning to FIG. 14, illustrated are exemplary components for attaching arm frame section 1302 to back section 212. For example, support plate 1402 can be secured to back section 212 via one or more screws. Circular shaft 1404 can be operatively attached to support plate 1402; for example, it could be welded to support plate 1402. In this example, the proximal portion of arm frame section 1302 can be operatively coupled (e.g., welded) to a cylindrical tube 1406. The cylindrical tube 1406 can be inserted into circular shaft 1404.

Figure 15:
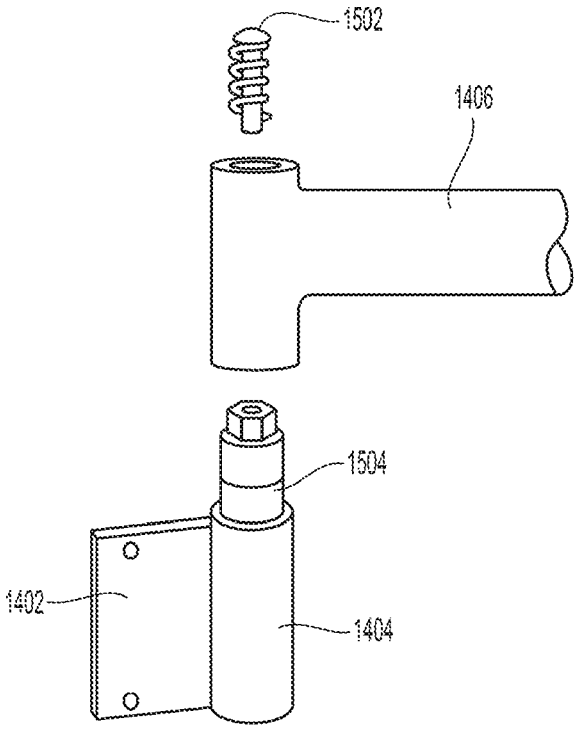
FIG. 15 is an exploded view of components for rotatably coupling an arm frame support to an exemplary back section of an apparatus.

FIG. 15 is an exploded view of components for rotatably coupling an arm frame section to an exemplary back section of an apparatus. Referring to FIG. 15, shown is cylindrical tube 1406 detached from circular shaft 1404. In the illustrated embodiment, the male connection of circular shaft 1404 can include hexagon-shaped rotating member 1504. The end that is visible in FIG. 15 can mate with a female end within cylindrical tube 1406. Hexagon-shaped rotating end 1504 can be threaded to receive screw 1502 to secure cylindrical tube 1406 to circular shaft 1404. The other portion of hexagon-shaped rotating member 1504 can extend within circular shaft 1404 and have a tooth that engages with a housing within circular shaft 1404 that prevents hexagon-shaped rotating end 1504 from rotating more than 180 degrees.

Turning now to FIG. 16, illustrated is a top view of the left front portion of frame 122 and an exemplary rotatable assembly. In an embodiment, frame 122 can have a "T" shaped front portion configured to support leg plate 802. The proximal end of leg plate 802 is shown to include a gear-like end that includes one or more gear teeth 1602. Spring pin assembly 818 can be configured to position a pin such that it engages a space in between two teeth herein referred to as a groove. In this exemplary configuration, the pin can be used to secure the position of leg plate 802 such that it will prevent leg plate 802 from rotating. In the instance where a tattoo artist wants to adjust the position of the leg sections in order to, for example, tattoo a client's inner thigh, the tattoo artist can pull on a handle attached to the distal end of spring pin assembly 818 to disengage the axle pin 814 from a groove and pull on release lever 820 to rotate leg frame 804 from the position illustrated in FIG. 16 to the position illustrated in FIG. 17. The tattoo artist can release the handle of the spring pin assembly 818, and the spring can force the axle pin 814 to engage a groove, thereby locking leg frame 804 into position. In an exemplary embodiment, the gear-like portion of leg plate 802 can include, for example, five teeth spaced such that each groove can lock leg frame 804 in increments of 20 degrees about the vertical axis (i.e., parallel to the frontal and midsagittal planes). In an exemplary embodiment, each groove can be used to lock leg frame 804 at 15, 35, 55, 75, and 90 degrees from the midsagittal plane of the apparatus. One skilled in the art can appreciate that the number and spacing of teeth is variable and that, while one embodiment is illustrated, it is contemplated that any number of teeth and any spacing can be used.

Turning now to FIG. 17, illustrated is the exemplary apparatus in the chair configuration with the exemplary rotatable assembly configured such that the left leg is about 75 degrees from the midsagittal plane.

Figure 18:
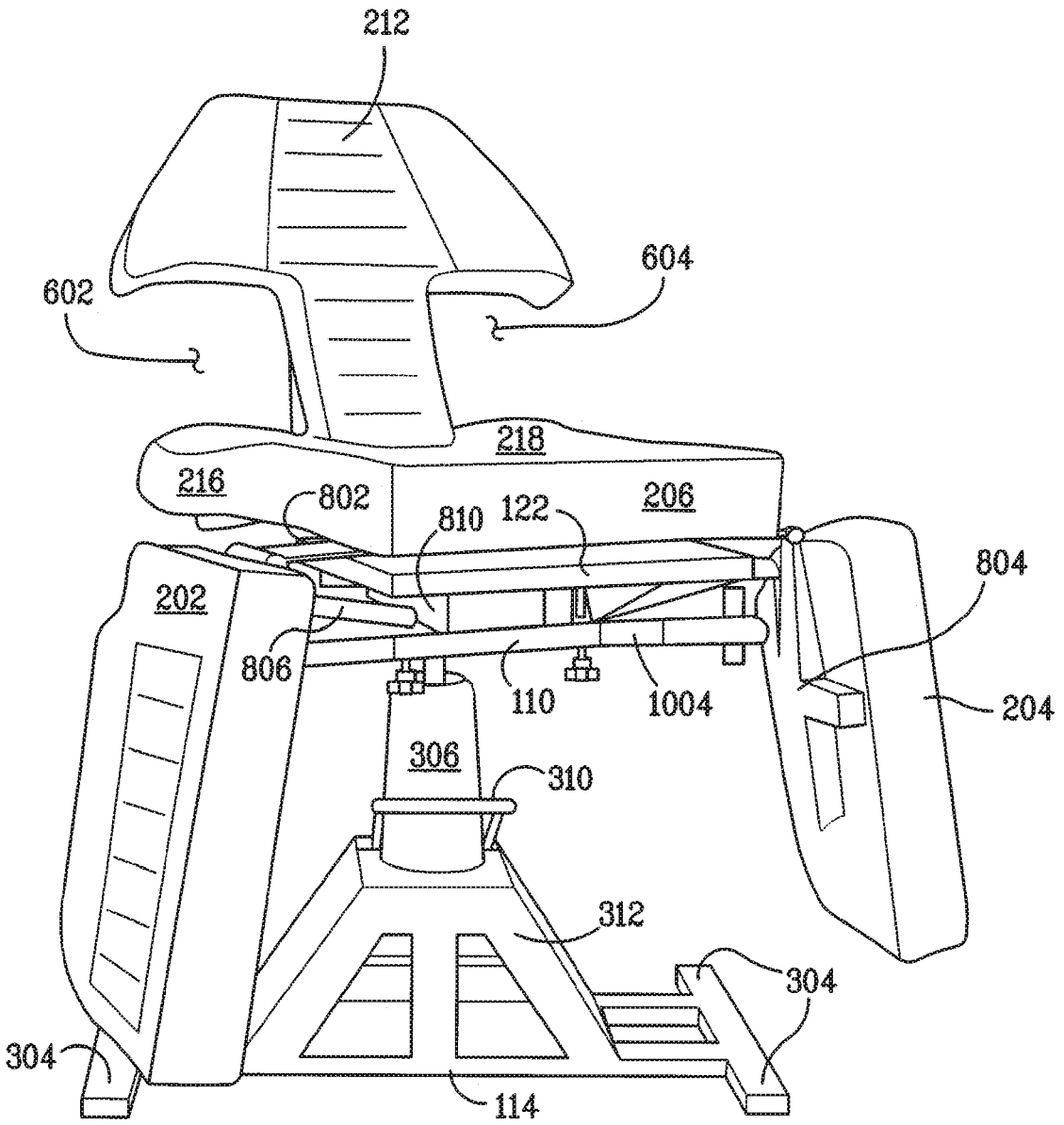
FIG. 18 illustrates an exemplary apparatus in a chair configuration with leg supports rotated about a vertical plane.

FIG. 18 shows the exemplary apparatus in the chair configuration with leg sections 202 and 204 rotated into a position in which they are generally perpendicular to the midsagittal plane. In this example, vertical shafts 1008 and arm sections 208 and 210 have been removed. This exemplary embodiment can be used for tattooing the lower back portion of a client. For example, the client can straddle back section 212 by placing his or her legs through the cuts that define leg openings 602 and 604. The tattoo artist can use hydraulics system 306 to raise or lower the position of seat section 206 to place the client's lower back in a position where it is comfortable for the tattoo artist to work and comfortable for the client. In this exemplary embodiment, the client can lean forward and rest his or her chest on the padded top portion of back section 212. This action causes the skin of the client's back to naturally stretch, thereby aiding the tattoo artist in the application of a tattoo. The tattoo artist can also rotate the apparatus into the illustrated position in order to move his or her chair closer to the client. That is, the tattoo artist can roll a chair in between stabilizer plate sections 304.

Figure 19:
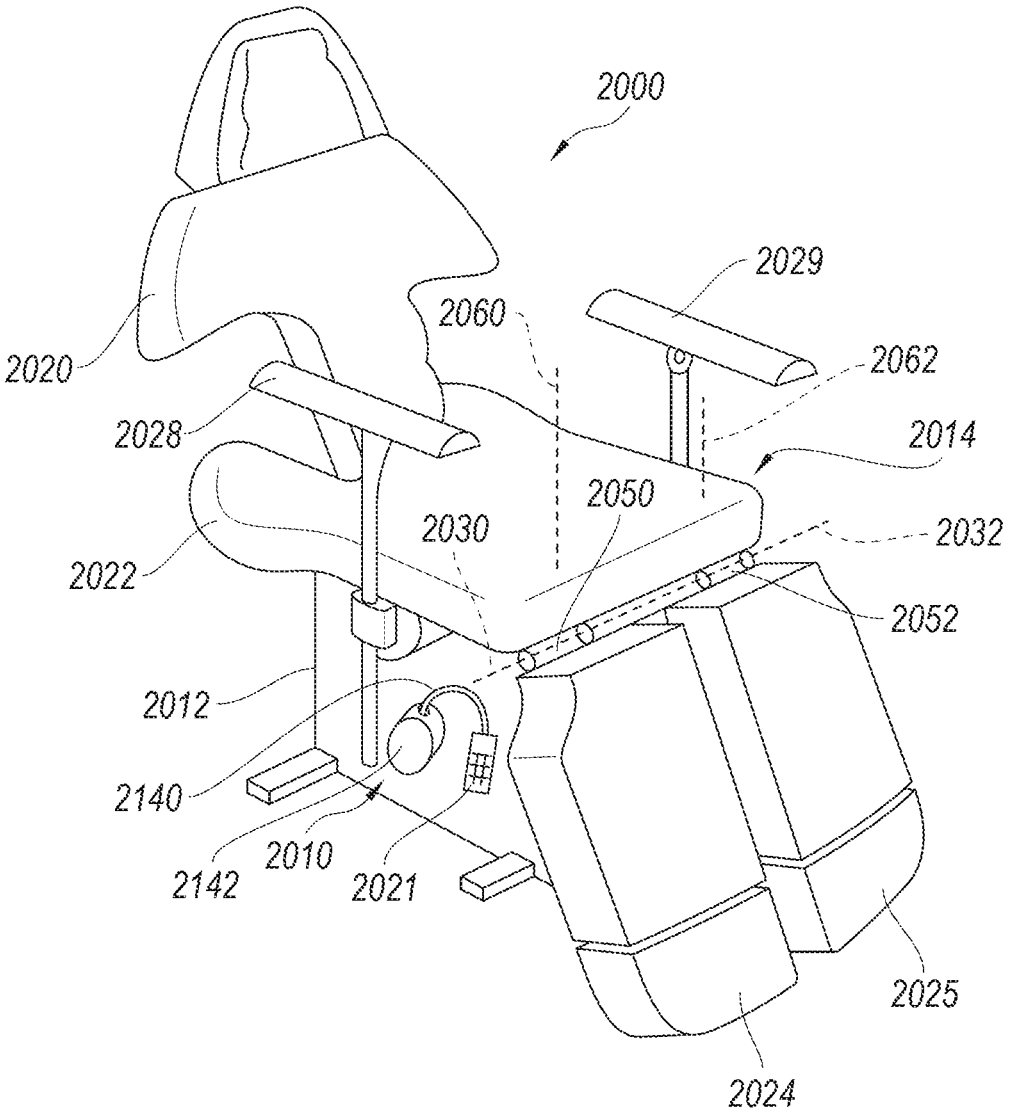
FIG. 19 is an isometric view of an exemplary apparatus in a chair configuration in accordance with another embodiment.
Figure 20:
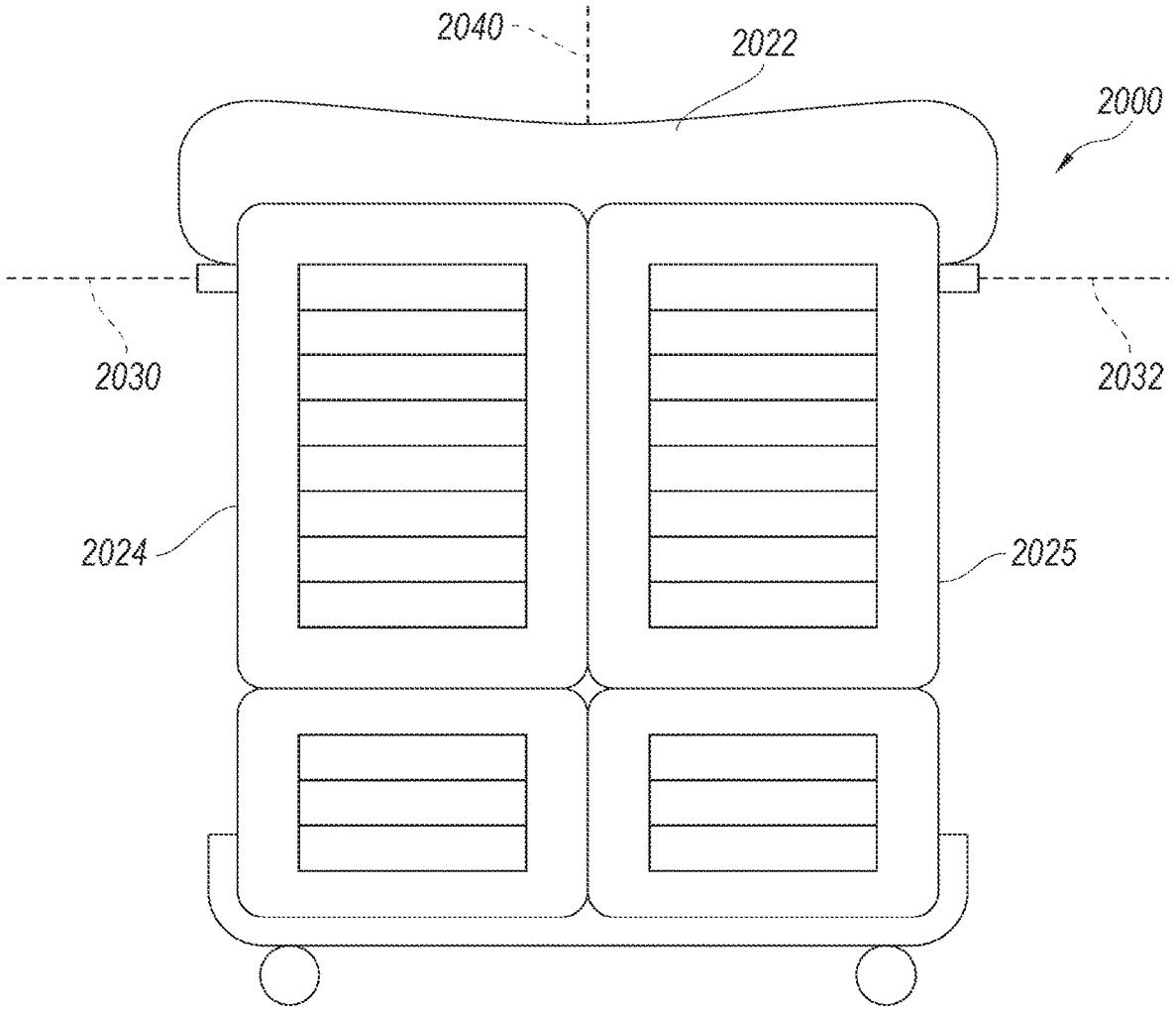
FIG. 20 is a front view of a portion of the apparatus of FIG. 19 with lowered leg assemblies in a forward position.
Figure 21:
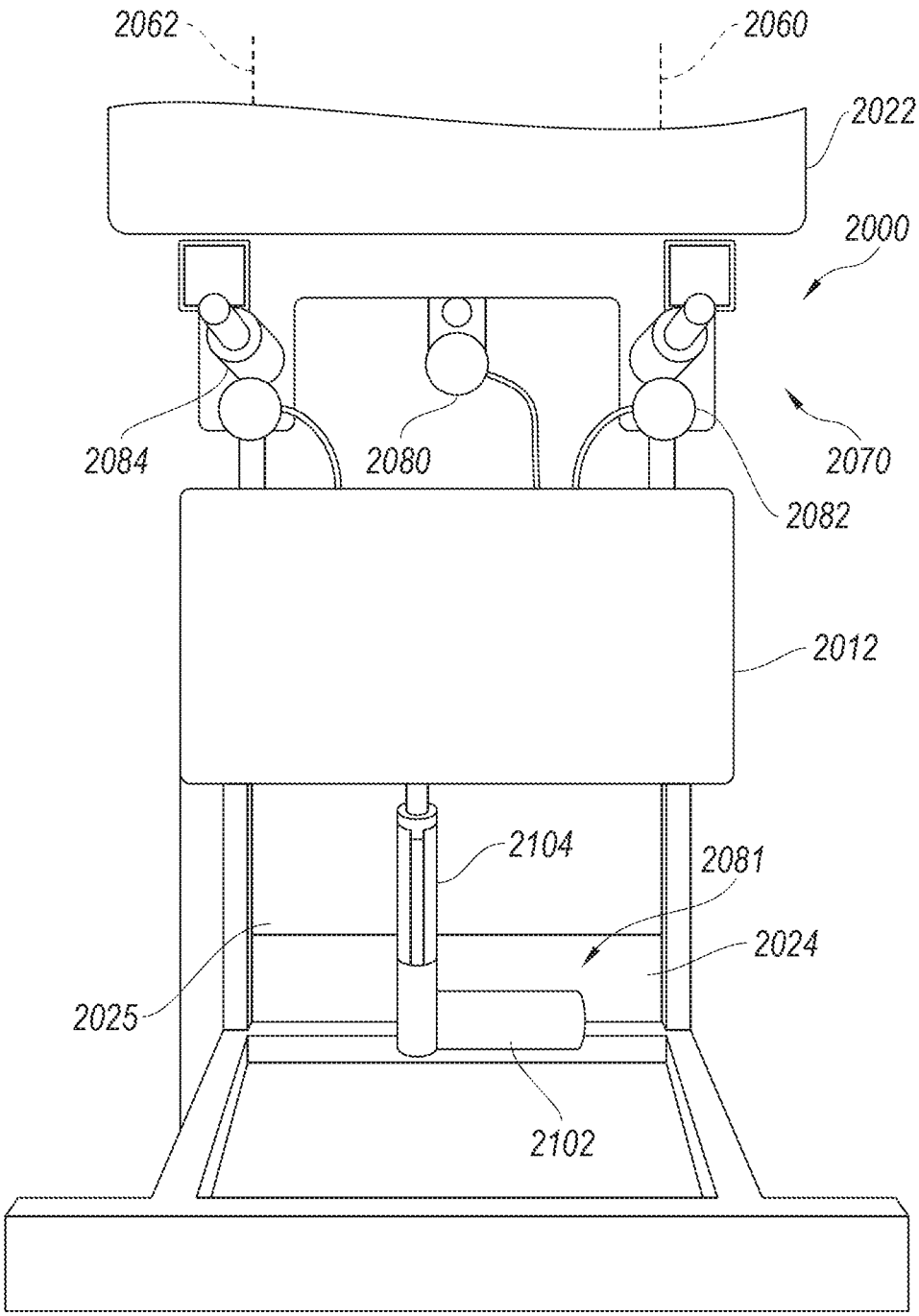
FIG. 21 is a rear view of the portion of an apparatus of FIG. 20 in accordance with one embodiment.

FIG. 19 is an isometric view of an exemplary apparatus 2000 in a chair configuration in accordance with another embodiment. FIG. 20 is a front view of a lower portion of the apparatus 2000 with lowered leg assemblies in a forward position. FIG. 21 is a rear view of the lower portion of the apparatus 2000 in accordance with one embodiment. Referring now to FIG. 19, the apparatus 2000 can include a control system 2010, a chassis or base 2012, and a support assembly 2014. The control system 2010 can be part of or carried by the base 2012 and can include a handheld controller 2021. The support assembly 2014 can include, without limitation, a back section 2020, a seat section 2022, leg assemblies or sections 2024 and 2025, and arm sections 2028 and 2029 movable relative to one another. A tattoo artist can use the controller 2021 to conveniently reposition the back section 2020, a seat section 2022, leg assemblies 2024 and 2025, and/or arm sections 2028 and 2029.

FIGS. 20 and 21 show the lowered leg sections 2024 and 2025 in a forward position. The apparatus 2000 includes a drive mechanism 2070 (shown in FIG. 21) for moving the leg assemblies 2024, 2025. Each of the leg assemblies 2024, 2025 is configured to support one of the client's legs while the forward-facing client sits on the seat section 2022. The controller 2021 (not shown) can be used to rotate the leg assemblies 2024, 2025 about axes of rotation 2030, 2032 (FIG. 20), respectively. The illustrated axes of rotation 2030, 2032 of FIG. 20 are at a generally horizontal orientation. In some embodiments, one or both axes of rotation 2030, 2032 are generally perpendicular to the midsagittal plane 2040 (FIG. 20) and/or parallel to a transverse or frontal plane of the apparatus 2000.

FIG. 19 shows rotational devices 2050, 2052 that can define the axes of rotation 2030, 2032, respectively, and can be hinges, rotatable joints, or other components. The leg assemblies 2024, 2025 can be rotated about axes of rotation 2060, 2062, respectively, to move away from or toward the midsagittal plane. One or both axes of rotation 2060, 2062 can be generally vertical and, in some embodiments, parallel to the frontal plane and/or midsagittal plane of the apparatus 2000. The axes of rotation 2030, 2032, 2060, 2062 can be at other orientations, selected based on the desired motion of the leg assemblies 2024, 2025.

Figure 22:
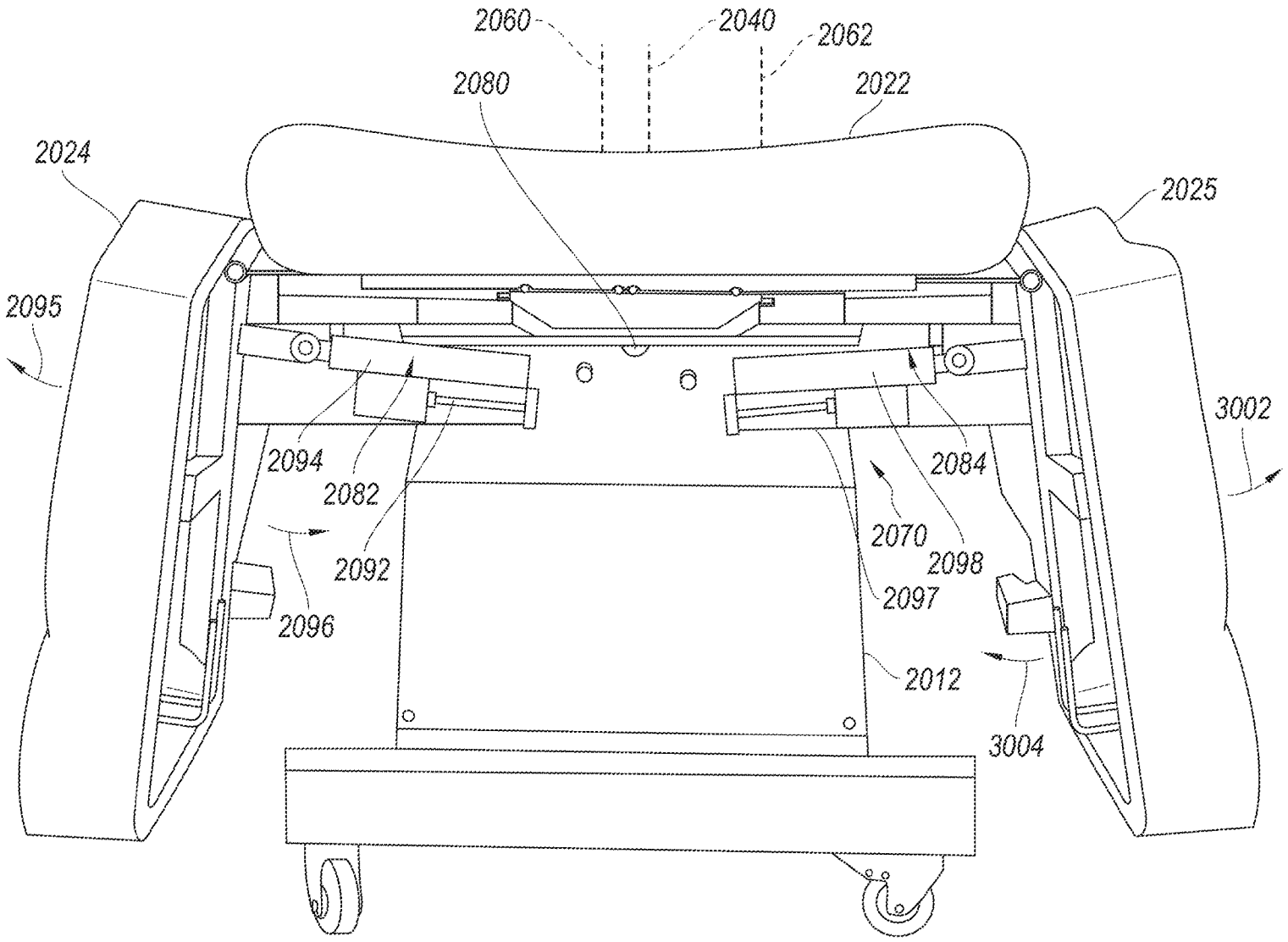
FIG. 22 is a front view of a portion of the apparatus of FIG. 19 with the lowered leg assemblies in an outward or lateral position.

FIG. 22 shows a front view of a portion of the apparatus 2000 with the lowered leg assemblies 2024, 2025 at open or widened positions. Referring now to FIGS. 21 and 22, a drive mechanism 2070 can include one or more drive devices in the form of leg drive devices 2080, 2082, 2084 coupled to the seat section 2022, frame, or other component, such as the base 2012. The leg drive devices 2080, 2082, 2084 can include, without limitation, one or more actuators (e.g., linear actuators, rotary actuators, etc.), motors, rail mechanisms, and/or other components for providing desired motion. The motors can include, without limitation, drive motors, stepper motors, servomotors, or other motors. In some embodiments, the leg drive device 2080 includes an electric motor for sequentially or concurrently driving the leg assemblies 2024, 2025 about the axes of rotation 2060, 2062, respectively. The leg drive device 2082 includes a motor 2092 and a linear actuator 2094 that can be extended or compressed to rotate the leg assembly 2024 upwardly (indicated by arrow 2095 in FIG. 22) or downwardly (indicated by arrow 2096 in FIG. 22) about the axis of rotation 2030 (FIG. 20).

The description of the leg drive device 2082 applies equally to the leg drive device 2084. The leg drive device 2084 can include a motor 2097 and a linear actuator 2098 that can be extended or compressed to rotate the leg assembly 2025 upwardly (indicated by arrow 3002 in FIG. 22) or downwardly (indicated by arrow 3004 in FIG. 22) about the axis of rotation 2032 (FIG. 20). The position and configuration of the leg drive devices 2080, 2082, 2084 can be selected based on the desired range of motion of the leg assemblies 2024, 2025.

Referring again to FIG. 21, a base drive device 2081 is configured to move (e.g., translate, rotate, etc.) the seat section 2022 and can include one or more motors 2102 and actuators 2104. The actuator 2104 can extend or compress to, for example, raise or lower the seat section 2022. The chassis or base 2012 can include one or more hinges, linear slides, joints, other components for providing desired motion of the seat section 2022, or other component.

Figure 23:
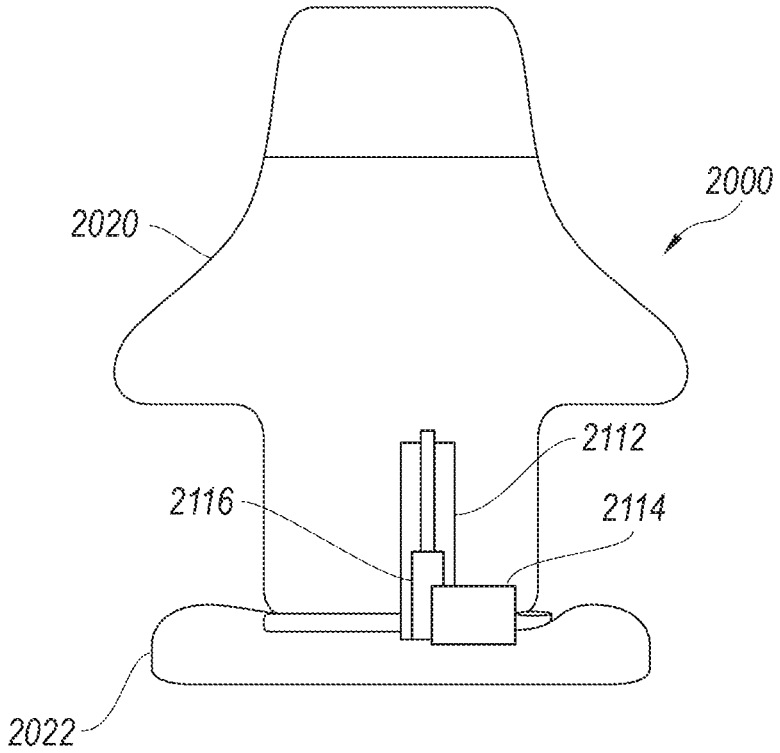
FIG. 23 is a rear view of the back section of an apparatus in accordance with one embodiment.

FIG. 23 is a rear view of the back section 2020 and seat section 2022 of the apparatus of FIG. 19. The apparatus 2000 includes a back drive device 2112 operable to move the back section 2020 relative to the seat section 2022. The back drive device 2112 can include one or more motors 2114 and actuators 2116. The motor 2114 can be operated to extend or compress the actuator 2116 to rotate the back section 2020 forward or rearward.

Figure 24:
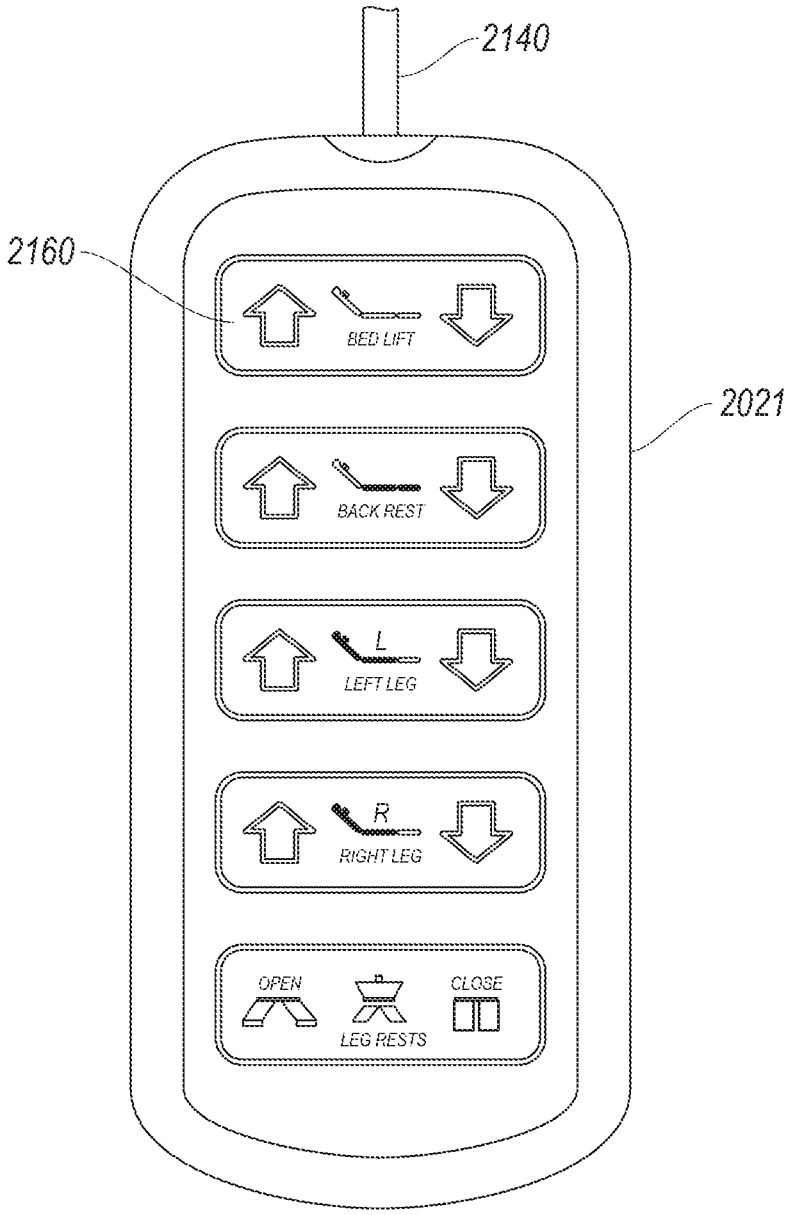
FIG. 24 shows a controller in accordance with one embodiment.

FIG. 24 illustrates the controller 2021 that can be in communication with the components of the apparatus 2000 via, for example, a direct wired connection, a wireless connection, or a network connection. For example, FIG. 19 shows a direct wired connection provided by connector 2140 (e.g., an electrical cord) that can be housed in a retraction mechanism 2142. The controller 2021 can be coupled to the base 2012 (FIG. 19) via hook and loop fastener, a clip, or other coupling feature. The connector 2140 can be a flexible electrical cord stored in a housing of the retraction mechanism 2142 located along the base 2012. In wireless embodiments, the controller 2021 can be a handheld electronic device, such as a tablet, smart phone, or the like, and it can include digital electronic circuitry, firmware, hardware, memory, a computer storage medium, a computer program, processor(s) (including programmed processors), or the like. The artist or client can remove the controller 2021 and use it to conveniently reconfigure the apparatus 2000.

FIG. 24 shows the controller 2021 with input elements in the form of buttons (one is identified as 2160) for individually controlling bed movement, back section movement, leg section movement, arm section movement, or the like. The movement can be rotation, translation, or other type of movement. By way of example, the leg sections can be raised, lowered, or moved between open and closed configurations. The number of input elements can be selected based on the number of movable components, degrees of freedom for each component, etc. In some embodiments, the controller 2021 includes a touchscreen.

The control systems disclosed herein can include electrical components within the controller 2021 or other components of the apparatuses. In some embodiments, the control system 2010 of FIG. 19 can include one or more processors, Programmable Logic Controllers, Distributed Control Systems, secure processors, memory, and the like. Secure storage may also be implemented as a secure flash memory, secure serial EEPROM, secure field programmable gate array, or secure application-specific integrated circuit. Processors can be standard central processing units or secure processors. Secure processors can be special-purpose processors (e.g., reduced instruction set processors) that can withstand sophisticated attacks that attempt to extract data or programming logic. A secure processor may not have debugging pins that enable an external debugger to monitor the secure processor's execution or registers. In other embodiments, the system may employ a secure field programmable gate array, a smartcard, or other secure devices. Other types of computing devices can also be used.

Memory can include memory, such as standard memory, secure memory, or a combination of both memory types. By employing a secure processor and/or secure memory, the system can ensure that both data and instructions are highly secure. Memory can be incorporated into the other components of the controller system and can store computer-executable or processor-executable instructions, including routines executed by a programmable computing device. In some embodiments, the memory can store programs for preset configurations. For example, one input device (e.g., button) can correspond to a particular configuration, such a flat or bed configuration, leg assembly configuration (e.g., open or spread out configuration, closed configuration, etc.), back/seat configuration, or the like. By pressing a button a single time, the control system 2010 can select the executable program for controlling various drive mechanisms to reconfigure the apparatus 2000. The stored programs can be modified by the user to provide flexibility. The tattoo artist can select and modify preset configurations of the apparatuses disclosed herein. Additionally, if an apparatus is used by multiple artists, the control system can store preset configurations for each artist. For example, when the tattoo artist initially begins a tattoo session, that tattoo artist can select his or her profile and can then select an appropriate program for configuring the apparatus. To program a preset configuration, the tattoo artist can use the buttons to adjust the position of various components of the apparatus. After the apparatus is at a desired configuration, the tattoo artist can use a preset selection button of the controller to store that preset configuration. That preset configuration can be identified by a number, client/customer name, or other identifier, and it can be selected at any time to reconfigure the apparatus to that configuration.

The control systems disclosed herein can be switched between different modes, including an opening mode for moving leg assemblies between positions (e.g., from a forward position to a lateral position), a closing mode for moving the leg assemblies together (e.g., from the lateral position to the forward position), a raising/lowering mode for vertically moving the seat section, a back adjust mode for rotating the back section, and and a preset or programmed configuration mode. In some embodiments, electronic drive mechanisms of the apparatuses disclosed herein have an opening mode for moving leg assemblies between a forward position to the lateral position and a closing mode for moving the leg assemblies from the lateral position to the forward position.

Figure 25:
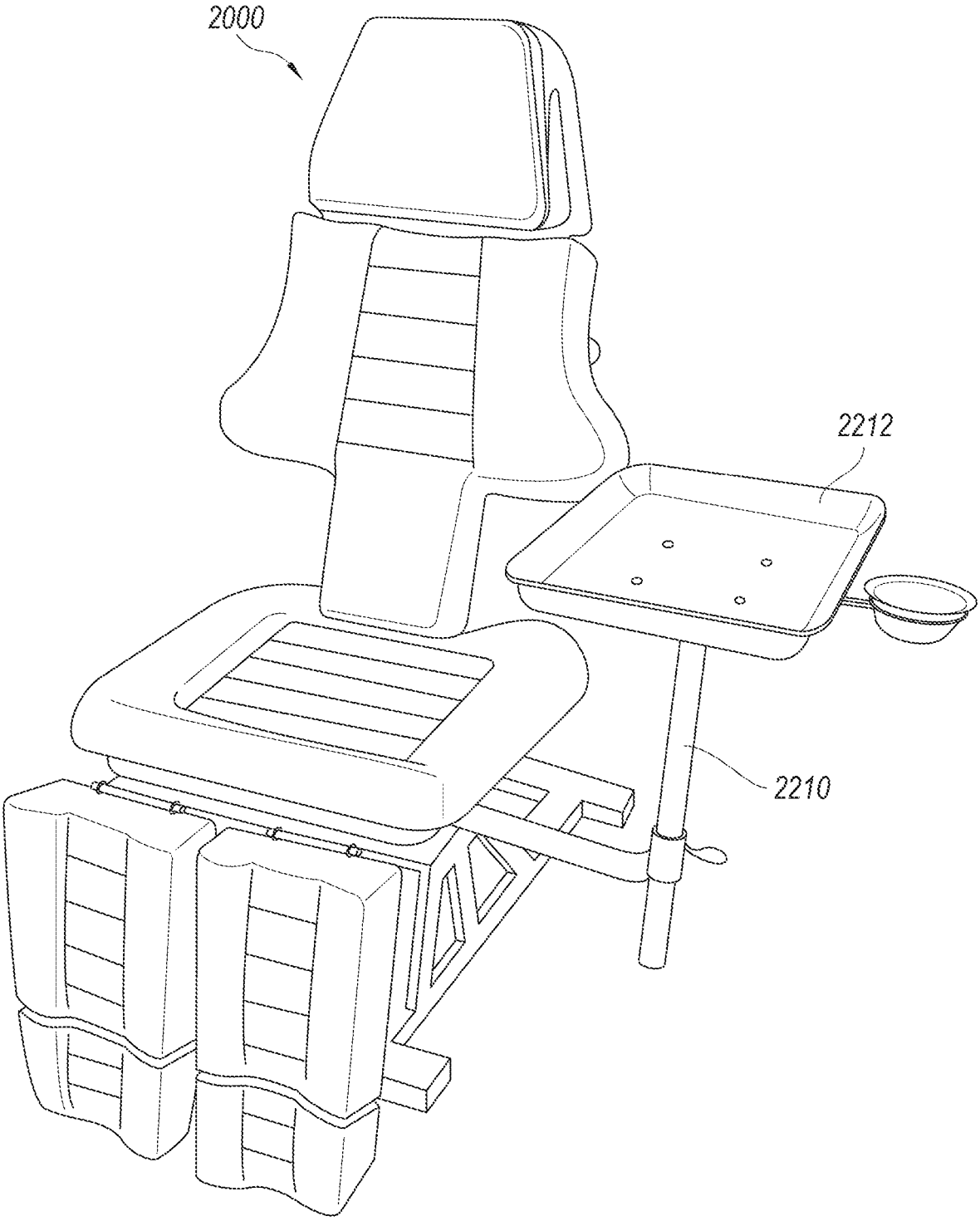
FIG. 25 illustrates an exemplary apparatus with a tray assembly.

FIG. 25 illustrates the exemplary apparatus 2000 with arm sections 2028 and 2029 removed and an installed tray assembly 2200. The tray assembly 2200 includes a post 2210 and a tray 2212. The post 2210 can be a vertical shaft or other component suitable for connecting the tray 2212 to a frame of the apparatus 2000. The tray 2212 can hold tattoo instruments, needles, ink, or other tattooing accessories. Clamps, holders, tension levers, or other coupling devices can couple the tray assembly 2200 to a frame or other component of the apparatus 2000. Other accessories can be installed on the apparatus 2000.

The various embodiments described above can be combined to provide further embodiments. For example, the apparatus 2000 discussed in connection with FIGS. 19-23 can include the frame and other features discussed in connection with FIGS. 1-18. The arm sections 208, 210, 2028, and 2029, leg sections 202, 204, 2024, and 2025, seat sections 206 and 2022, and/or back sections 212 and 2020 can include rigid members (e.g., frame members), cushioning members (e.g., foam members, padding, etc.), coverings (e.g., leather coverings, plastic covers, etc.), thermal elements (e.g., heating/cooling elements), or the like. For example, apparatuses 2000 can include heating or cooling elements for controlling the temperature of the sections supporting a client. The control systems 2010 can be used to adjust the temperature.

Although the embodiments disclosed herein have been discussed primarily for use with tattooing, the apparatuses can be used in different applications. For example, the apparatuses discussed herein can be used in medical settings, massage therapy facilities, or for other applications in which a subject's body is positioned at different configurations. The construction and configuration of the apparatuses disclosed herein can be selected based on the desired reconfigurability. The drive mechanisms and features discussed in connection with FIGS. 19-21 can also be incorporated into or used with the embodiments discussed in connection with FIGS. 1-18. Additionally, the apparatuses disclosed herein can be reconfigured pneumatically or hydraulically. For example, the apparatus 2000 discussed in connection with FIGS. 19-21 can have pneumatic or hydraulic drive mechanisms. The electrical components disclosed herein can be powered by an AC power source or other suitable source. All of the U.S. patents, U.S. patent application publications, and U.S. patent applications referred to in this specification and/or listed in the Application Data Sheet are incorporated herein by reference, in their entireties.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

What is claimed is:

1. A support apparatus, comprising:

a seat section having a back region and a front edge;

a back section including a first leg opening and a second leg opening, wherein the back section includes a padded chest portion and a padded narrowed portion extending from the padded chest portion to the seat section and wherein the padded chest portion is configured to support a subject that is sitting on the seat section and straddling the padded narrowed portion such that the subject's first leg is positioned in the first leg opening and the subject's second leg is positioned in the second leg opening;

a first leg assembly configured to be raised and lowered and being movable from a first front position to a first side position, wherein the first leg assembly in the front position is subjacent the front edge of the seat section when the first leg assembly is at a lowered position; and a second leg assembly configured to be raised and lowered and being movable from a second front position to a second side position, wherein the second leg assembly in the second front position is subjacent the front edge of the seat section when the second leg assembly is at a lowered configuration, wherein the first and second leg assemblies are independently movable relative to one another.

2. The support apparatus of claim 1, further comprising a positioning assembly including a plunger having an unlocked position for allowing rotation of the first leg assembly between the first front position and the first side position and a locked position for locking the first leg assembly at a selected position.

3. The support apparatus of claim 1, wherein the first leg assembly moves laterally from the first front position toward the first side position.

4. The support apparatus of claim 1, wherein most of a leg support surface of the first leg assembly is moved rearwardly past the front edge of the seat section when the first leg assembly is moved from the first front position to the first side position.

5. The support apparatus of claim 1, wherein at least one of the first leg assembly or the second leg assembly is positionable below an upper surface of the seat section when the at least one of the first leg assembly or the second leg assembly is moved rearwardly.

6. The support apparatus of claim 1, further comprising at least one pivot mechanism positioned under an upper surface of the seat section, the at least one pivot mechanism defining an axis of rotation about which the first leg assembly rotates to move between the first front position and the first side position.

7. The support apparatus of claim 1, wherein the first leg assembly is rotatable about a first axis of rotation to move from the first front position toward the first side position and is rotatable about a second axis of rotation to be raised and lowered.

8. The support apparatus of claim 7, wherein the first axis of rotation is positioned between the back region and the front edge.

9. A support apparatus comprising:

a back section having first and second leg openings;

a seat section having a first side and a second side;

a first leg assembly configured to be raised and lowered and being movable between a first front configuration and a first side configuration while a user straddles the support apparatus and faces the back section, wherein the first leg assembly is positioned to support a first leg of the user when in the first front configuration and the user's back is against the back section, wherein the first leg assembly is located along the first side of the seat section when in the first side configuration, and wherein the first and second leg openings are positioned such that the user can swing his/her legs laterally into and out of the first and second leg openings when the user straddles the back section; and a second leg assembly configured to support a second leg of the subject when the subject is supported by the seat section and the user's back is against the back section.

10. The apparatus of claim 9, wherein the first leg assembly is subjacent the first side when in the first side configuration, and the first leg assembly is subjacent the second side when in the second side configuration.

11. The apparatus of claim 9, wherein the first leg assembly can be locked at a raised horizontal position or a lowered vertical position independent of whether the first leg assembly is at the front configuration or side configuration.

12. The apparatus of claim 9, wherein the first leg assembly is movable between the first front configuration and the side position independent of the position of the second leg assembly.

13. The apparatus of claim 9, wherein the support apparatus is movable between a chair configuration and a bed configuration.

14. An apparatus for supporting a subject, the apparatus comprising:

a seat section having a front edge and a back edge;

a back section having a first leg opening and a second leg opening such that the subject can straddle the back section by placing a first leg of the subject in the first leg opening and a second leg of the subject in the second leg opening;

a first leg support movable between a first forward position and a first rearward position, wherein at least a portion of a first leg support surface of the first leg support is positioned rearwardly of at least a portion of the front edge of the seat section when the first leg support is in the first rearward position, and wherein the first leg support in the first forward position is located to support one of the subject's legs when the subject's back is supported by the back section;

a second leg support movable between a second forward position and a second rearward position; and first and second armrests attached to the back section and rotatable between first and second positions, wherein— when the first and second armrests are in the first position, the first and second armrests extend away from a front side of the back section and are positioned to support the subject's arms when the subject's back is supported by the back section, and when the first and second armrests are in the second position, the first and second armrests extend away from a back side of the back section and are positioned to support the subject's arms when the subject is straddling the back section.

15. The apparatus of claim 14, wherein the first leg support is rotatable about a first axis of rotation to move between the first forward position and the first rearward position; and the second leg support is rotatable about a second axis of rotation to move between the second forward position and the second rearward position, wherein at least one of the first axis of rotation or second axis of rotation is positioned between the front edge and the back edge.

16. The apparatus of claim 15, wherein the first leg support is rotatable about a third axis of rotation to move between a first lowered position and a first raised position, and the second leg support is rotatable about a fourth axis of rotation to move between a second lowered position and a second raised position.

17. The apparatus of claim 16, wherein the third axis of rotation extends in a substantially horizontal direction when the first axis of rotation extends in a substantially vertical direction.

18. The apparatus of claim 15, wherein the first axis of rotation and the second axis of rotation are positioned between the front edge and the back edge.

19. The apparatus of claim 15, wherein the seat section includes rearwardly extending leg supports positioned to support the subject's legs when the subject straddles the back section.

20. The apparatus of claim 15, wherein the first and second axes of rotation are substantially vertical when the apparatus is supported by a substantially horizontal support surface.

21. The apparatus of claim 15, further comprising a leg positioner operable to selectively lock and unlock one or both first and second leg support.

22. The apparatus of claim 15, wherein most of a leg support surface of the first leg support moves rearwardly of the front edge of the seat section when the first leg support is moved from the first forward position to the first rearward position.

23. The support apparatus of claim 1 wherein the first and second leg openings are positioned such that the subject's first leg can swing laterally into and out of the first leg opening and the subject's second leg can swing laterally into and out of the second leg openings when the subject sits on the seat section and straddles the back section and the subject's first and second legs hang downwardly.

24. A support apparatus movable between a bed configuration and a chair configuration, the support apparatus comprising:

an assembly including a seat section and a back section, wherein the seat section has a back region and a front edge, and wherein the back section is configured to support a subject that is sitting on the seat section;

a first armrest rotatably coupled to the assembly, a second armrest rotatably coupled to the assembly;

a first leg assembly movable from a first front position to a first side position, wherein the first leg assembly in the front position is subjacent the front edge of the seat section when the first leg assembly is at a lowered position, and wherein when the support apparatus is in a chair configuration, the first leg assembly at the first side position is below the first armrest such that the subject's first leg can be positioned under the first armrest and supported by the first leg support; and a second leg assembly movable from a second front position to a second side position, wherein the second leg assembly in the second front position is subjacent the front edge of the seat section when the second leg assembly is at a lowered configuration, and wherein when the support apparatus is in the chair configuration, the second leg assembly at the second side position is below the second armrest such that the subject's second leg can be positioned underneath the second armrest and supported by the second leg support.

25. The support apparatus of claim 24, wherein the first leg assembly is rotatable about an axis of rotation that extends through the seat section.

26. The support apparatus of claim 14 wherein the first and second armrests are positioned to support the subject's forearms on the back side of the back section when the armrests are in the second position and the subject is straddling the back section.

27. The apparatus of claim 14, wherein each of the first and second armrests is independently movable between the first and second positions.

28. The apparatus of claim 14, further include padding on opposing surfaces of both of the first and second armrests.

* * * * *